US012188183B2

(12) United States Patent
Kotilainen et al.

(10) Patent No.: US 12,188,183 B2
(45) Date of Patent: Jan. 7, 2025

(54) SUPERCALENDERED KRAFT PAPER COMPRISING RECYCLED FIBER

(71) Applicant: UPM-KYMMENE CORPORATION, Helsinki (FI)

(72) Inventors: Jukka Kotilainen, Helsinki (FI); Mikko Rissanen, Helsinki (FI); Petteri Lannes, Helsinki (FI)

(73) Assignee: UPM-KYMMENE CORPORATION, Helsinki (FI)

( * ) Notice: Subject to any disclaimer, the term of this patent is extended or adjusted under 35 U.S.C. 154(b) by 0 days.

(21) Appl. No.: 18/091,505

(22) Filed: Dec. 30, 2022

(65) Prior Publication Data

US 2024/0218598 A1 Jul. 4, 2024

(51) Int. Cl.

| | |
|---|---|
| ***D21H 15/00*** | (2006.01) |
| ***D21H 17/00*** | (2006.01) |
| ***D21H 27/00*** | (2006.01) |
| ***D21H 27/06*** | (2006.01) |

(52) U.S. Cl.
CPC ..... *D21H 5/12* (2013.01); *D21H 3/00* (2013.01); *D21H 5/0075* (2013.01); *D21H 5/0077* (2013.01)

(58) Field of Classification Search
CPC ..... D21H 5/12; D21H 3/00; D21H 5/0075; D21H 5/0077
See application file for complete search history.

(56) References Cited

U.S. PATENT DOCUMENTS

| | | | | |
|---|---|---|---|---|
| 2005/0126729 | A1* | 6/2005 | Koskinen | D21G 1/00 162/158 |
| 2009/0104431 | A1* | 4/2009 | Kishida | D21H 19/36 428/323 |
| 2010/0203318 | A1* | 8/2010 | Galembeck | D21H 19/38 427/361 |
| 2017/0190799 | A1* | 7/2017 | Rissanen | C09J 7/405 |
| 2018/0298556 | A1* | 10/2018 | Xu | D21H 17/43 |
| 2020/0173109 | A1* | 6/2020 | Saukkonen | B32B 27/10 |
| 2021/0340708 | A1* | 11/2021 | Kosonen | C08F 8/48 |

* cited by examiner

*Primary Examiner* — Jacob T Minskey
*Assistant Examiner* — Stephen M Russell
(74) *Attorney, Agent, or Firm* — CANTOR COLBURN LLP

(57) ABSTRACT

The invention relates to a supercalendered Kraft paper production for a release liner, which contains both non-recycled bleached chemical pulps and recycled pulp produced from release liner supercalendered Kraft paper. When highly specific raw material is used for recycling, the characteristics of the recycled pulp may be adjusted already upon recycling. The recycled pulp obtained from supercalendered Kraft paper that has been used as a substrate of a release liner may be used without further refining for manufacturing supercalendered Kraft paper. Excessive refining can thus be avoided and the compatibility of the recycled pulp may be optimized for supercalendered Kraft paper production. The non-recycled pulps may be refined less, as well. This leads to positive effects in supercalendered Kraft paper manufacturing process, such as improved dewatering and energy efficient drying. The produced paper demonstrates reduced shrinkage and improved dimensional stability, while maintaining sufficient quality for use as a substrate for a release liner. A supercalendered Kraft paper with improved sustainability is produced.

8 Claims, 6 Drawing Sheets

SUPERCALENDERED KRAFT PAPER COMPRISING RECYCLED FIBER

FIELD OF INVENTION

The invention relates to a supercalendered Kraft paper suitable for a release liner and a method to manufacture such paper, which contains both non-recycled bleached chemical pulps produced from hardwood and softwood, as well as recycled pulp produced from release liner supercalendered Kraft paper.

BACKGROUND

The release liner market is experiencing significant growth. A release liner may be used to protect sensitive surfaces prior to use, such as the adhesive surface of an adhesive label. Release liners are widely used in high-speed industrial labelling processes, wherein the number of products to be labelled can be very large. This necessitates large amount of release liners as carriers for the labels. High-speed processes require reliable die-cutting and detachment of adhesive labels from a release liner. Unintentional break to the labelling process due to a release liner defect is problematic. Therefore, a release liner needs strength and a homogeneous surface displaying stable release properties. Both may be provided but are expensive to obtain. The expectation of high quality thus extends to the paper used as a release liner substrate, which should have sufficient characteristics to withstand the stresses applied at high-speed processes.

Supercalendered Kraft paper is a distinguished type of paper that is used as a release liner substrate due to its outstanding characteristics. Supercalendered Kraft paper is expensive, as it is typically produced of bleached chemical pulp, hereafter abbreviated as BCP, that has been highly refined. The production of supercalendered Kraft paper is a complex process, which requires skills, large amounts of virgin wood-based material and energy. The BCP used for producing supercalendered Kraft paper is typically a pulp mixture that contains both BCP made of softwood and BCP made of hardwood. Virgin BCP made of softwood, in particular, is very expensive, whereby in general majority of the furnish, up to 70-80% by weight, of the supercalendered Kraft paper is typically virgin BCP made of hardwood. However, BCP made of softwood is preferred, due to the longer fibers in BCP made of softwood. Part of the longer average fiber length of BCP made of softwood, however, is lost due to the refining of the pulp, which is performed prior to introducing the furnish on the paper machine.

Refining is a mill operation performed on the BCP prior to manufacturing supercalendered Kraft paper, wherein the pulp fibers are subjected to high shear forces. This modifies the pulp fibers physically, for example by fibrillation, such that the fiber structures become looser. The extent of refining of a pulp may be determined by a Schopper-Riegler test, which measures the drainability of a pulp suspension in water in terms of the Schopper-Riegler number, referred to as the SR number or ° SR. Refining further reduces the average fiber length of the pulp fibers. Consequently, the specific volume of the formed supercalendered Kraft paper is also reduced, since shorter fibers may be packed together closer. This also enables to manufacture supercalendered Kraft paper having higher surface smoothness and density. A smooth and dense paper surface is advantageous for reducing the consumption of a subsequent release coating, upon producing a release liner. However, refining also increases the moisture uptake of the BCP, denoted as swelling, since the loosened fiber structure of refined BCP is better accessible for water molecules. Thus, refining increases the amount of water to be removed from the formed paper web, when manufacturing supercalendered Kraft paper on a paper machine. Upon drying the paper web on a paper machine, the excess water to be removed from the fibers may cause shrinkage, which changes the dimensions of the supercalendered Kraft paper and is also detrimental for the paper quality, such as paper strength. Refining of the pulp thus causes multiple effects downstream on the supercalendered Kraft paper manufacturing process. While some effects of refining are positive and improve the supercalendered Kraft paper quality, others are not.

To balance the effects of extensive refining and to obtain the final paper quality characteristics, such as smoothness, thickness, density and transparency, a supercalendered Kraft paper is typically surface sized and strongly calendered, by means of a multi-nip calender or a supercalender.

Sustainability drives the paper manufacturers to develop the products and their manufacturing methods at the paper mill. While paper has been collected for recycling for a long time, the circulation of recycled paper waste into a specific paper production, such as supercalendered Kraft paper production, poses challenges. The pulp obtained from such material has presented reduced quality and is used in products where quality is of less importance.

A large proportion of the industrial paper grades, such as papers used for printing and writing, use different kind of furnish than what is typically used when manufacturing supercalendered Kraft paper for a release liner. Many paper types which are primarily meant for conveying information to consumers also contain relatively high amount of various printing inks. This needs to be considered, since dye-based and pigment-based inks have different deinkability properties.

Label waste poses other types of challenges, as the material to be recycled may often contain plastic and adhesive label remnants. A release liner, on the other hand, contains cured silicone polymer that has been adhered on the paper surface.

As an example, U.S. Pat. No. 5,316,621 discloses that supercalendered paper used as a material for release liner is very difficult to defiberize, as it is made of highly beaten pulp fibers and comprising a release agent such as a silicone compound. The publication suggests an accelerated method, involving acid addition and elevated temperature, followed by kneading, fine screening and mechanically agitating a thickened slurry at a temperature below 12° C. Mineral pigments are desirably added to the process to obtain better effects.

In the past, considerable technical challenges thus have been disclosed when attempting to reuse release liner material, without assurance of the quality of the repulped material.

SUMMARY

The growing sustainability requirement leads to considerably larger quantities of release liners being produced for the labelling industry, where paper is used as a release liner substrate. The industrial use of such release liners in larger quantity enables a targeted collection and sorting of used release liners for recycling. Of particular interest is the collection and sorting of release liner, wherein the substrate is supercalendered Kraft paper. A release liner, wherein the substrate is supercalendered Kraft paper, is hereafter referred to as release liner supercalendered Kraft paper and abbreviated as RSCK.

RSCK recycling provides means for supercalendered Kraft paper production to be more sustainable, while solving challenges mentioned above. Fibers of RSCK display signs of damages due to extensive hornification and no longer have the same characteristics as fibers of virgin BCP made of softwood. However, sorting of RSCK apart from other paper waste provides specific and highly homogeneous material for recycling, which enables to better adjust characteristics of the material already during the recycling process. This is advantageous, as the compatibility of the recycled pulp can thus be adapted and optimized for supercalendered Kraft paper production. For instance, excessive refining of the recycled pulp may be avoided. In particular, pulp produced from RSCK may be used to replace non-recycled BCP in the composition of the supercalendered Kraft paper. Recycled pulp obtained from RSCK may thus be circulated back to the manufacturing process. A more closed loop is therefore possible for the papermaking fibers.

Hereafter, a method is disclosed for manufacturing recycled pulp from release liner supercalendered Kraft paper, the method comprising:

sorting release liner supercalendered Kraft paper for recycling, disintegrating the sorted release liner supercalendered Kraft paper and detaching non-fibrous material from the fibers on a first process stage, referred to as a caustic loop, and removing non-fibrous material from the fibers on a second process stage, referred to as a cleaning loop, wherein the method, the caustic loop and the cleaning loop have been configured to adjust the fibrillation of the pulp suspension, such that the recycled pulp obtained from the release liner supercalendered Kraft paper has a pulp fibrillation and drainability in a range which enables the use of the recycled pulp obtained from the RSCK in a method for manufacturing supercalendered Kraft paper. Advantageously, the caustic loop and the cleaning loop have been configured to adjust the fibrillation of the pulp such that the recycled pulp obtained from the RSCK can be used in a method for manufacturing supercalendered Kraft paper without further refining.

Recycled pulp obtained from RSCK has a pH which is in an alkaline range, when determined from aqueous pulp extracts. An alkaline pH during the recycling process softens the pulp, which thereby requires less energy for refining. An alkaline pH, however, may inhibit the subsequent drying of the pulp. The pulp pH may thus be adjusted, as necessary, prior to mixing the pulp with other pulp components. Advantageously, when using the recycled pulp obtained from RSCK in a method for manufacturing supercalendered Kraft paper suitable for use as a substrate of a release liner, the recycled pulp obtained from supercalendered Kraft paper that has been used as a substrate of a release liner has a pH which is in the range of 6.0 to 9.1. Preferably the pH is in the range of 7.0 to 8.5, since a highly alkaline pH may inhibit the functioning of cationic UV curing silicone systems. Most preferably, the pH in the range of 7.5 to 8.2, whereby the drying and the compatibility of the recycled pulp can be optimized for supercalendered Kraft paper production.

Recycled pulp obtained from RSCK is very quick to refine, compared to non-recycled pulp components. Recycled pulp obtained from RSCK also has a relatively high SR number, compared to non-recycled bleached chemical pulps, which have not been refined. Hence, the recycled pulp obtained from RSCK may be used in supercalendered Kraft paper production without further refining. When the fibrillation and drainability of a recycled pulp obtained from RSCK has been adjusted to a suitable level already beforehand, the recycled pulp obtained from RSCK may be directly mixed with other non-recycled pulp components in a method for manufacturing supercalendered Kraft paper. Advantageously, recycled pulp obtained from RSCK has a SR number equal to or higher than 25, such as in a range from 25 to 65, preferably in the range of 30 to 60, most preferably in the range of 40 to 55, when determined according to ISO 5267-1.

Recycled pulp obtained from RSCK comprises an average fiber length that is in the same range as in non-recycled BCP made of hardwood. The average fiber length of recycled pulp obtained from RSCK is, however, significantly less than in non-recycled BCP made of softwood or mill broke used for supercalendered Kraft paper production. The amount of fibrils in the pulp obtained from RSCK also differs from the amount of fibrils in the non-recycled BCP. The recycled pulp obtained from RSCK typically contains particles derived from the recycled pulp having a length less than 200 micrometers in an amount equal to or higher than 10%, such as in a range from 10 to 30%, preferably in the range of 12 to 20%, most preferably in the range of 15 to 17%, when determined by automated optical analysis using unpolarized light according to ISO 16065-2: 2014. The fibers of the recycled pulp obtained RSCK typically have an average fiber width of less than 25 micrometers, preferably in the range of 19-25 micrometers, most preferably in the range of 19-21 micrometers, when determined by automated optical analysis using unpolarized light according to ISO 16065-2: 2014.

Fiber furnish analysis according to ISO 9184-4 in conjunction with ISO 9184-1 may be used for fiber identification and to determine the fiber properties of a given pulp. In combination with pulp drainage analyses, such as measurement of the pulp water retention value and/or the SR number, these analyses distinguish recycled pulp obtained from supercalendered Kraft paper that has been used as a substrate of a release liner.

Empirical studies indicate that recycled pulp obtained from RSCK comprises very good characteristics for supercalendered Kraft paper production, throughout the manufacturing method, at a paper machine. The fibers of recycled pulp obtained from RSCK are less accessible for water molecules.

Recycled pulp obtained from RSCK therefore inhibits the moisture uptake of the stock. The water retention value of recycled pulp obtained from RSCK is low, typically lower than in non-recycled BCP. The amount of recycled pulp obtained from RSCK may therefore be used to control the dry matter content of the stock, upon forming the paper web. The reduced ability of the recycled pulp obtained from RSCK to absorb moisture also leads to enhanced dewatering of the paper web, already at the press section of the paper machine. Upon entering the drying section, the paper web therefore contains less moisture which needs to be evaporated. Hence, less steam pressure is needed, which improves the energy efficiency of the drying section during the paper production.

The compounded effects of reduced refining, improved dewatering and more efficient drying are observable by methods, which measure the water retention and drying behaviour of the paper web. For instance, when the amount of recycled pulp obtained from RSCK in the stock is increased, the water retention value decreases. This indicates that less water needs to be removed on the press section, during supercalendered Kraft paper production. Pulp analyses from a paper mill further indicate that replacement of non-recycled BCP with recycled pulp obtained from RSCK in a pulp mixture results to an increase in the fines content in the pulp mixture, when determined as the $F_{<200}$ fraction with McNett classifier according to SCAN-CM 6:05. This indicates, that recycled pulp obtained from RSCK may be used to adjust the quality of the paper web formed on the paper machine. Experimental results indicate positive effects also downstream in the supercalendered Kraft paper production process. Drainability is related to the surface conditions and swelling of the fibres and is an indicator of the amount of mechanical treatment to which the pulp has been subjected. A paper web, which contains recycled pulp obtained from RSCK, demonstrates improved drainage on a paper machine. A higher amount of the recycled pulp obtained from RSCK in the stock correlates with the level of drainage, such that less steam pressure is needed for drying. Unexpectedly, a reduction of 0.1 bar in the steam pressure may be obtained already with an amount of 5 wt. % of recycled pulp obtained from RSCK in the composition, when drying the supercalendered Kraft paper. When the amount of recycled pulp obtained from RSCK in the composition is 15 wt. %, 0.3 bar less of steam pressure may be used for drying the supercalendered Kraft paper. A considerable amount of energy may thus be saved.

Further to this, paper machine off-line analyses demonstrate that the produced paper has less shrinkage and less variability of the grammage in the cross-direction at a paper machine, which correlates with the amount of the recycled pulp obtained from RSCK. The amount of shrinkage is an indicator of dimensional stability. The smaller variability of the grammage in the cross-direction at a paper machine is an indicator of more homogeneous product. A supercalendered Kraft paper which comprises recycled pulp obtained from RSCK thus has improved quality characteristics. Experimental results also evidence of reduced curl in paper samples comprising recycled pulp obtained from RSCK. The improved properties of the supercalendered Kraft paper are of importance, when considering the use of supercalendered Kraft paper as a substrate, on which a release coating is subsequently spread and cured.

Typically, a supercalendered Kraft paper has a grammage equal to or less than 120 g/m$^2$, such as in the range of 50 to 120 g/m$^2$. When produced for use as a substrate of a release liner, a lower grammage may be preferred, such as in the range of 55 to 90 g/m$^2$, most preferably in the range of 60 to 80 g/m$^2$. A lower grammage may be calendered into a supercalendered Kraft paper with less thickness and higher transparency. The thickness of a supercalendered Kraft paper may be controlled by calendering and hence correlates with the grammage and density.

Recycled pulp obtained from RSCK enables to maintain quality characteristics of supercalendered Kraft paper at a sufficient level, while enabling recycling of the used end product, a release liner supercalendered Kraft paper, back into the manufacturing process. A sufficient level of quality characteristics, in this context, refers to a supercalendered Kraft paper having a density in the range of 1.030 to 1.190 g/cm$^3$, and a transparency in the range of 36 to 56%. Advantageously the density is in the range of 1.050 to 1.190 g/cm$^3$, most preferably in the range of 1.060 to 1.180 g/cm$^3$, determinable by standard ISO 534. Advantageously the transparency is in the range of 38 to 54%, most preferably in the range of 40 to 52%, determinable by standard ISO 2469. The combination of density and transparency is of relevance, as it can be used as an index of the compressibility level of the supercalendered Kraft paper. A supercalendered Kraft paper, which is intended to be used as a release liner substrate, needs suitably low compressibility in the thickness direction $S_z$ parallel to surface normal of the paper, as the release liner typically acts as backing material for face material comprising an adhesive layer. The face material is shaped into labels with cutting die that is pressed against the face material with a predefined pressure. When the release liner substrate exhibits suitably low compressibility, the blades cut through the face material into a predefined depth, such that the face material comprising the adhesive layer may be stripped away around the cut area without damaging the substrate. The combination of density and transparency therefore indicates the suitability of the supercalendered Kraft paper to function as a release liner substrate for adhesive labels.

According to a first aspect, there is provided a supercalendered Kraft paper suitable for use as a substrate of a release liner, the supercalendered Kraft paper comprising fibers from

- non-recycled bleached chemical pulp produced from hardwood,
- non-recycled bleached chemical pulp produced from softwood, and
- recycled pulp obtained from supercalendered Kraft paper that has been used as a substrate of a release liner, the supercalendered Kraft paper having

- a density equal to or higher than 1.030 g/cm$^3$, when determined according to ISO 534,
- a transparency equal to or higher than 36%, when determined according to ISO 2469,
- a CIE whiteness, wherein
  - L* is in the range of 92 to 98,
  - a* is in the range of −4 to +2, and
  - b* is in the range of +5 to +11,
- when determined according to ISO 11475:2017(en), and
- comprising the recycled pulp obtained from supercalendered Kraft paper that has been used as a substrate of a release liner in an amount equal to or higher than 5 wt. %, when determined as dry matter content according to SCAN-P 39:80.

According to a second aspect, there is provided a method for manufacturing supercalendered Kraft paper suitable for use as a substrate of a release liner, the method comprising

- mixing fibers from
  - recycled pulp obtained from supercalendered Kraft paper that has been used as a substrate of a release liner,
  - non-recycled bleached chemical pulp produced from hardwood, and
  - non-recycled bleached chemical pulp produced from softwood, such that a stock is obtained,
- forming a paper web of the stock on a paper machine,
- reducing moisture content of the paper web in a press section,
- drying the paper web in a drying section, thereby forming paper, and
- calendering the paper, thereby forming supercalendered Kraft paper, the supercalendered Kraft paper having
- a density equal to or higher than 1.030 g/cm$^3$, when determined according to ISO 534,
- a transparency equal to or higher than 36%, when determined according to ISO 2469, a CIE whiteness, wherein L* is in the range of 92 to 98, a* is in the range of −4 to +2, and b* is in the range of +5 to +11, when determined according to ISO 11475:2017(en), and comprising the recycled pulp obtained from supercalendered Kraft paper that has been used as a substrate of a release liner in an amount equal to or higher than 5 wt. %, when determined as dry matter content according to SCAN-P 39:80.

The recycled pulp obtained from RSCK may be used to replace non-recycled BCP made of hardwood and/or softwood. Non-recycled BCP, in this context, may also be referred to as virgin BCP. When recycled pulp obtained from RSCK is used to replace non-recycled BCP, the refining of non-recycled BCP in the supercalendered Kraft paper manufacturing process may be reduced. Reduced refining of the non-recycled BCP preserves the quality of the fibers. In particular, non-recycled BCP made of softwood has a longer average fiber length than other components in the stock and can be used to improve the internal bond strength upon formation of the paper web. Advantageously, the non-recycled BCP produced from softwood, prior to mixing with recycled pulp obtained from RSCK, has a Schopper-Riegler number equal to or less than 50, such as in a range from 25 to 50, preferably in the range of 25 to 45, most preferably in the range of 25 to 40, when determined according to ISO 5267-1. Advantageously, the composition of a supercalendered Kraft paper contains non-recycled BCP produced from softwood in an amount equal to or higher than 10 wt. %, preferably in the range of 10 to 50 wt. %, most preferably in the range of 10 to 30 wt. %, when determined as dry matter content according to SCAN-P 39:80.

The preserved quality of the BCP fibers may be used for compensating negative effects, which the damaged fibers in the recycled pulp obtained from RSCK may cause to paper formation, when manufacturing supercalendered Kraft paper at a paper machine. Advantageously, the preserved quality of the fibers in the non-recycled BCP is used to increase the proportion of recycled pulp obtained from RSCK in the composition of the supercalendered Kraft paper. Hence, a synergy is perceived, when using recycled pulp obtained from RSCK together with non-recycled BCP in a method for manufacturing supercalendered Kraft paper. The composition of a supercalendered Kraft paper advantageously contains recycled pulp obtained from RSCK in an amount equal to or higher than 5 wt. %, more preferably in an amount equal to or higher than 10 wt. %, most preferably in an amount equal to or higher than 15 wt. % or in an amount equal to or higher than 30 wt. %, such as in the range of 5 to 50 wt. %, preferably in the range of 10 to 45 wt. %, most preferably in the range of 15 to 30 wt. %, when determined as dry matter content according to SCAN-P 39:80.

When manufacturing white supercalendered Kraft paper, the recycled pulp obtained from RSCK may be produced without bleaching. Thus, a supercalendered Kraft paper suitable for use as a substrate of a release liner may comprise fibers from non-recycled bleached chemical pulp produced from hardwood and softwood, as well as recycled pulp obtained from supercalendered Kraft paper that has been used as a substrate of a release liner, which recycled pulp has not been bleached. Advantageously, the recycled pulp obtained from RSCK is produced of white RSCK grades. A white RSCK does not contain colorants. A white RSCK grade may be used to produce white supercalendered Kraft paper. Paper whiteness and white colour, in this context, refer to CIE L*, a*, b* colour space coordinate values, wherein L* is in the range of 92 to 98, a* is in the range of −4 to +2, and b* is in the range of +5 to +11, the values measured by means of diffuse reflectance method with the elimination of specular gloss, using standard illuminant D65 and 10° standard observer, in accordance with ISO 11475:2017(en).

Hence, there is further provided use of recycled pulp obtained from white release liner supercalendered Kraft paper in a method for manufacturing white supercalendered Kraft paper suitable for use as a substrate of a release liner.

Objects and embodiments of the invention are further described in the independent and dependent claims.

SUMMARY OF THE FIGURES

The symbols $S_x$, $S_z$ and $S_y$, as used herein, refer to coordinate directions orthogonal to each other.

DETAILED DESCRIPTION

A Release Liner Supercalendered Kraft Paper

A release liner supercalendered Kraft paper, abbreviated as RSCK, is used to describe a release liner, wherein the substrate is supercalendered Kraft paper. Multiple aspects distinguish RSCK from other paper types collected for recycling.

Supercalendered Kraft paper denotes a specific paper type which is suitable for use as a substrate of a release liner. Supercalendered Kraft paper is conventionally prepared from highly refined bleached chemical pulp that has been strongly calendered, whereby it possesses an exceptional combination of high density, strength and transparency, which are beneficial characteristics for a release liner substrate.

Typical characteristics defining a supercalendered Kraft paper are

- smoothness of at least 900 sec/min (ISO 5627),
- grammage equal to or less than 120 g/m$^2$ (ISO 536),
- density equal to or higher than 1.030 g/cm$^3$ (ISO 534), wherein the density refers to grammage (ISO 536) per thickness (ISO 534:2011),
- porosity equal to or less than 15000 μm/Pas (ISO 11004), and
- transparency of equal to or higher than 36% (ISO 2469), the parameter values corresponding to ISO standards referred in parentheses.

A supercalendered Kraft paper suitable for release liner typically has

- a grammage in the range of 50 to 120 g/m$^2$ (ISO 536),
- a density in the range of 1.030 to 1.190 g/cm$^3$ (ISO 534), and
- a transparency in the range of 36 to 56%, (ISO 2469), A high transparency is preferred, such as in the range of 38 to 54%, most preferably in the range of 40 to 52% (ISO 2469).

The thickness of a supercalendered Kraft paper denotes thickness in micrometers after a calendering treatment, prior to applying a release coating. Thickness, unless otherwise stated, refers to the apparent thickness, determined as single sheet thickness (ISO 534:2011). Supercalendered Kraft paper is calendered with a supercalender before or after applying a primer coating. Calendering enables to produce a supercalendered Kraft paper having high density surface and high transparency, but may lead to moderate reduction in the burst, tensile, and tear strength of the supercalendered Kraft paper. Calendering also reduces the thickness of the supercalendered Kraft paper to a predefined target thickness. Supercalendered Kraft paper is typically surface sized with a primer coating, which is chemically compatible with a silicone polymer release coating. The primer coating can be applied on one or both sides, typically in the range of 1 to 5 g/m$^2$, preferably an amount in the range of 1 to 2 g/m$^2$ per side is used. A primer coating for supercalendered Kraft paper generally comprises water soluble binders, such as starch, polyvinyl alcohol and/or carboxymethyl cellulose.

Figure 1:
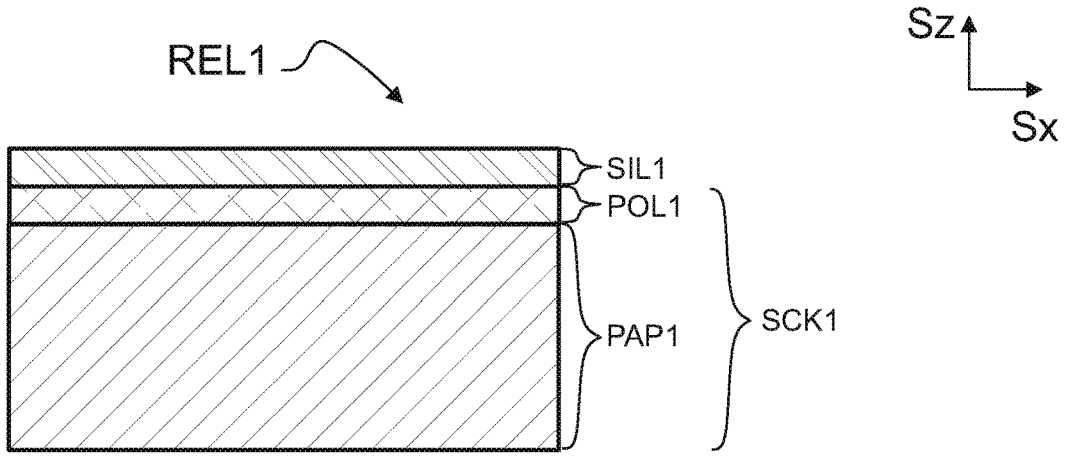
FIG. 1 shows, by way of an example, a cross-dimensional structure of a release liner, which comprises a surface sized paper substrate and a release coating.

Reference is made to FIG. 1, which, by means of an example, discloses a structural cross-dimensional view of release liner REL1, wherein the substrate SCK1 is a supercalendered Kraft paper. A release liner REL1, in this context, refers to an industrially manufactured paper product, which comprises a dehesive surface coating on at least one side of a calendered paper substrate SCK1. The dehesive surface coating is generally referred to as release coating SIL1. The dehesive surface coating may be used as a protective layer for an adhesive label which contains a face material and an adhesive layer.

A method for manufacturing a release liner REL1 comprises applying a release coating SIL1 on a paper substrate SCK1. The dehesive properties of the release coating SIL1 are typically obtained by means of an addition-curing silicone system in the presence of a suitable metal catalyst, such as platinum. An addition-curing silicone system comprises a reactive silicone polymer and a silane hydride cross-linker comprising functional vinyl groups, which are provided in a fluid form and may be spread on the paper substrate SCK1 in an amount of ca. 1 g/m$^2$. The reactive silicone polymer is typically a hydrophobic, silicon-based organic polymer, such as polydimethylsiloxane. When the release coating on the paper is exposed to a cross-linking temperature, typically in the range of 65-150° C., a chemical reaction initiates, which cures the release coating and anchors it on the substrate SCK1. This method enables to obtain a release liner REL1 which comprises a dehesive and hydrophobic surface coating layer based on a cured silicone polymer.

A supercalendered Kraft paper, when used as substrate SCK1 in a release liner REL1, typically comprises a paper PAP1 as support layer and a primer coating POL1. The paper PAP1 is manufactured on a paper machine on a machine direction $S_x$, which refers to the travelling direction of a paper web and paper on the paper machine. The properties of the paper may be different in the machine direction and in a direction perpendicular to the machine direction $S_x$ along the surface of the paper, referred to as the cross-direction $S_y$. The paper has a thickness in direction $S_z$ parallel to surface normal of the paper. Unlike many other paper types, supercalendered Kraft paper surface is typically not coated with mineral pigments, at least not in significant amounts. A supercalendered Kraft paper, however, in general comprises a primer coating POL1, such as a surface sizing applied on at least one side of the paper. Surface sizing improves the supercalendered Kraft paper surface characteristic, such as barrier properties. An advantageous primer coating POL1 is a water-soluble polyvinyl alcohol comprising hydroxyl groups. Some of the hydroxyl groups of the polyvinyl alcohol may have been modified to comprise reactive groups, such as vinyl groups. This enables the polymer to participate into the cross-linking reaction of the addition-curing silicone system. The primer coating POL1 thereby improves the anchorage of the dehesive surface coating layer to the paper substrate SCK1.

Due to high quality hydrophobic silicone polymers used nowadays in the release coatings for supercalendered Kraft paper, RSCK typically has a stable release value. Thus, after the adhesive labels have been removed, very low amount of adhesive residue remains on the release liner surface. A RSCK which has been used as a carrier for adhesive labels therefore contains very low amounts of adhesive residues.

A Method for Manufacturing Supercalendered Kraft Paper for a Release Liner

Figure 2:
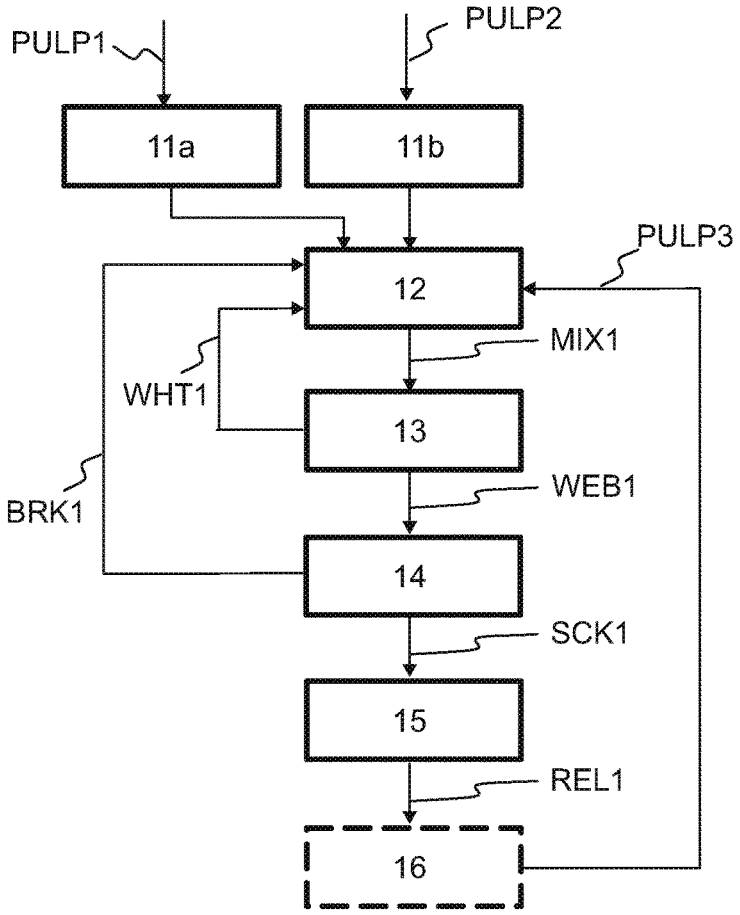
FIG. 2 shows, by way of an example, a method for manufacturing supercalendered Kraft paper, wherein the method a paper is formed from a stock that contains non-recycled bleached chemical pulp and recycled pulp obtained from supercalendered Kraft paper that has been used as a substrate of a release liner. The supercalendered Kraft paper may be used as a substrate for a release liner. The release liner supercalendered Kraft paper may be recycled and reused in the method for manufacturing supercalendered Kraft paper.

Reference is made to FIG. 2, which, by way of an example, presents a method for manufacturing supercalendered Kraft paper, which comprises refining 11*a*, 11*b* of pulps PULP1, PULP2, mixing 12 together pulps PULP1, PULP2, PULP3, and, optionally, broke BRK1 and white water WHT1, to obtain a stock MIX1, forming 13 a paper web at a headbox of a paper machine, and forming 14 a supercalendered Kraft paper on the paper machine.

The supercalendered Kraft paper is suitable for use as a substrate SCK1 in a method 15 for manufacturing a release liner REL1.

In the method for manufacturing supercalendered Kraft paper, a stock MIX1 is obtained after mixing 12 together different pulps during stock preparation. The mixing may be performed, for example by homogenising the stock MIX1 in a mixer. Stock refers to a pulp mixture from which paper is manufactured on a paper machine. Stock may also be referred to as furnish. Stock is fed to the forming section of a paper machine when manufacturing paper. A pulp suspension is needed to adjust loading upon stock preparation and to control fiber bonding, when forming a paper web 13 at a headbox of a paper machine. Thus, the stock is typically first fed to a machine chest. A machine chest is a consistency levelling unit, which provides a retention time such that any variations in consistency can be levelled out, prior to pumping the stock to a headbox, where it is dispensed evenly on to a moving wire at the forming section of a paper machine. Consistency is used to describe the percentage of oven dry mass from the total mass. The consistency of oven dry mass is 100%. The machine chest contains a valve system unit arranged to receive feedback from an on-line scanner measuring basis weight, which enables to adjust the basis weight of the paper to be formed.

Stock preparation may comprise loading and refining 11*a*, 11*b* of pulp components PULP1, PULP2 to provide a pulp mixture with desired characteristics. The pulp components PULP1, PULP2 may be refined separately. Depending on the paper to be manufactured, the stock MIX1 may further contain non-fibrous additives, such as sizing agents.

When manufacturing supercalendered Kraft paper comprising recycled pulp obtained from RSCK, the stock contains both non-recycled bleached chemical pulp produced from hardwood PULP1, non-recycled bleached chemical pulp produced from softwood PULP2 and recycled pulp obtained from supercalendered Kraft paper that has been used as a substrate of a release liner PULP3. Non-recycled pulp, in this context, refers to virgin pulp material which is introduced into a paper manufacturing process for the first time. The non-recycled pulp is bleached chemical pulp from a Kraft process. The stock MIX1 may contain broke BRK1, which refers to material produced on a paper machine, which is not up to specification, such as paper trimmings. Broke may be recycled back to the paper manufacturing process. Broke may be refined prior to mixing 12. However, broke has undergone at least part of a paper manufacturing process on a paper machine, and hence is not considered to be virgin pulp material, when introduced again into the paper manufacturing process. Broke is not obtained from a release liner REL1, either.

White water WHT1 may also be used, when preparing the stock MIX1. White water is used to describe slurry, which is formed at a forming section of a paper machine, when fine particles present in the stock drain from the formed paper web WEB1 into a pit below the paper machine. White water contains fines suspended in the stock. Fines refers to particles having a width in the range of 10 to 75 micrometers and a length less than 0.2 millimeters. White water may be circulated back into the stock preparation by means of a short circulation of the paper machine or treated and used elsewhere in the papermaking process. The amount of circulated fines defines a retention level, which describes the ability of the formed paper web to retain fines, and therefore the balance between drainage and formation 13 of the paper web.

On the forming section of the paper machine, after the paper web WEB1 is formed 13 from the pulp suspension and dewatered, the paper web is moved on a press section to reduce the moisture content of the paper web further. The press section of a paper machine typically comprises a number of rolls for guiding and/or pressing the paper web. The paper web is then moved from the press section to a drying section of a paper machine. In the drying section, the paper web is heated to evaporate most of the remaining moisture in the paper web. After drying section, the paper web may have a dry matter content level equal to or more than 90 wt.-%, for example in the range of 90 to 95 wt.-%, when determined according to SCAN-P 39:80. The forming of paper 14 therefore comprises a step for reducing moisture content of the paper web in a press section, and a step for drying the paper web in a drying section, thereby forming paper from a stock MIX1 that contains non-recycled bleached chemical pulp from hardwood PULP1, non-recycled bleached chemical pulp from softwood PULP2 and recycled pulp obtained from supercalendered Kraft paper that has been used as a substrate of a release liner PULP3.

A weight percentage, abbreviated as wt. %, is used to describe a weight fraction of component in a composition. A weight percentage of pulp is used to describe a weight fraction of a pulp in a material. A weight percentage of pulp in a paper denotes the dry weight of the pulp in a dry paper, when determined according to SCANP-39:80 test method for dry matter content. The dry weight of a sample is determined by weighing 20 grams of sample on a dish before and after oven drying at 105° C. and eliminating the mass of the empty dish from the measurement. Oven dry pulp has been dried at 105° C. until its mass is constant and cooled thereafter in an exicator to ambient temperature of 25° C., prior to weighing.

As explained above, the stock used for manufacturing supercalendered Kraft paper in this context is distinguished, as it contains mainly bleached chemical pulp made of softwood and hardwood. A recycled pulp obtained from RSCK, due to its origin, also contains mainly bleached chemical pulp made of softwood and hardwood. The surface of the supercalendered Kraft paper is typically sized with a water-soluble polymer, such as polyvinyl alcohol in an amount ranging from 1 to 5 g/m$^2$. A RSCK typically does not contain mineral fillers or coatings in significant amounts, such as kaolin (i.e. aluminium silicate dihydrate), clay pigments or calcium carbonate, when compared to other paper types, such as printing and writing papers. Thus, the ash content of a RSCK, determinable according to standard Tappi T 413 om-17, is generally very low, such a less than 3 wt. %, typically in the range of 1 to 3 wt. % of the weight of the paper.

The characteristics of supercalendered Kraft paper are typically obtained by using highly refined BCP, supercalendering and surface sizing agents. The supercalendering of Kraft paper is typically performed in a temperature in the range of 120 to 200° C. The line pressure used for supercalendering a Kraft paper is generally in the range of 300 to 500 kN/m. The Kraft paper is generally moistened prior to supercalendering, to enhance the effects. This increases the transparency of the supercalendered Kraft paper. The transparency of supercalendered Kraft paper is significantly higher than is typical for other paper types with similar grammage, except for glassine paper. Calendering increases surface density and transparency of the paper. Calendering also reduces specific volume and thickness of the paper. Supercalendered Kraft paper is very strong, has a very smooth and dense surface and excellent barrier properties. A smooth and dense surface, which resists the penetration of many fluids, is beneficial when spreading a release coating on the paper surface.

Supercalendered Kraft paper, as evident from the characteristics disclosed above, has not been designed for printing or writing. Instead, the supercalendered Kraft paper is often used as a substrate SCK1 to form 15 a release liner REL1, as indicated in FIG. 2. RSCK thus seldom contains printing inks in significant amounts. In general, RSCK is substantially unprinted, compared to other paper types, which facilitates the recycling 16 of the RSCK into pulp PULP3, which may be used to replace non-recycled bleached chemical pulp made of softwood PULP2 in the method for manufacturing supercalendered Kraft paper. RSCK thus possesses a combination of desired characteristics scarcely available in other paper types to the same extent.

RSCK is exceptional material, when considering it from a viewpoint of circular economy. When producing supercalendered Kraft paper from non-recycled BCP the fibers experience very harsh conditions. At a paper machine, the delignified hardwood and/or softwood fibers in the bleached chemical pulp undergo repeated drying and wetting cycles in the presence of chemicals, relatively high temperatures and high pressure. These treatments cause irreversible changes to the fiber structure, in particular to the pores formed between the cellulose protofibrils. This leads to reduced swelling capability of the fibers. The morphology as well as the ability of the fibres to swell is different, when compared to other type of fibers, such as, for instance, fibers from non-recycled bleached chemical pulp or broke. The phenomenon is specific for chemically pulped fibers. Due to this phenomenon, referred to as hornification, fibers derived from supercalendered Kraft paper display less bonding ability. Upon producing a release liner, the fibers are coated with a hydrophobic silicone polymer and heated, which exposes the fibers to further modifications.

Figure 3:
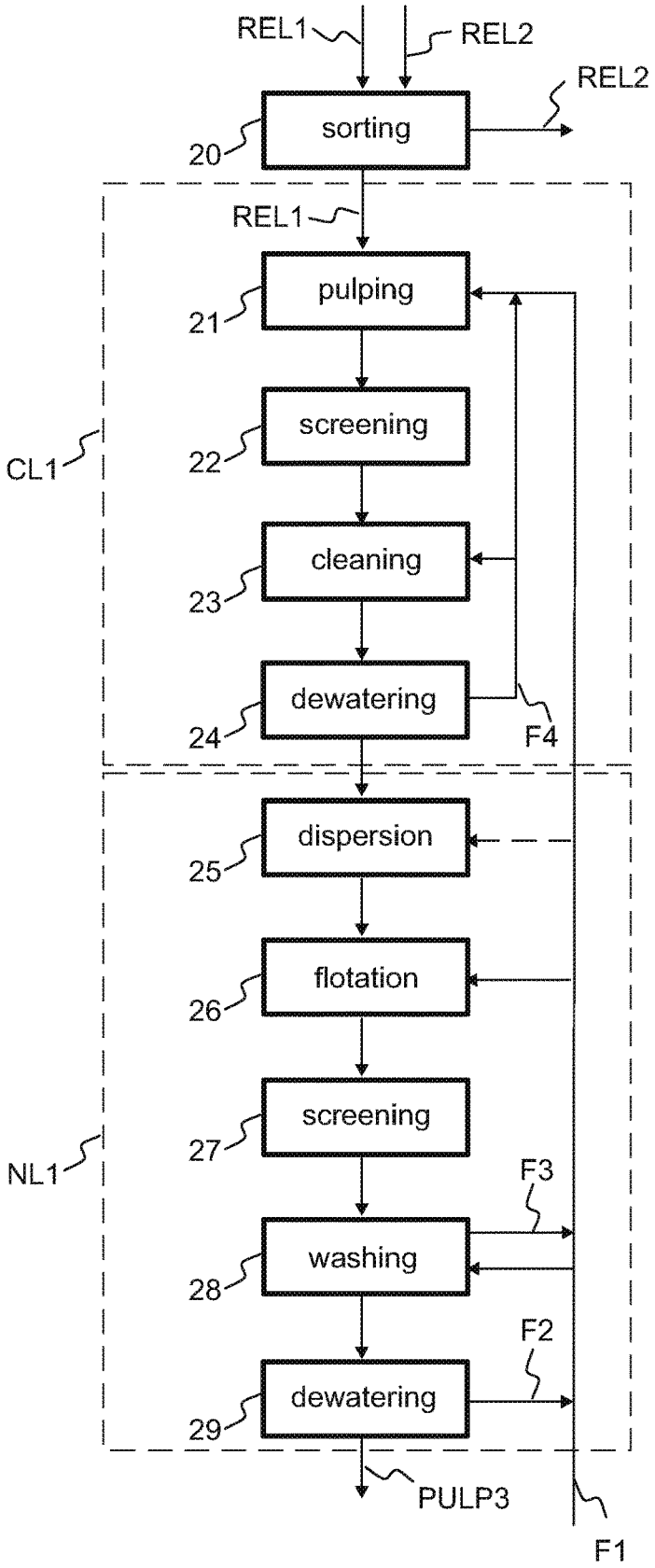
FIG. 3 shows, by way of an example, a method for manufacturing recycled pulp from a release liner supercalendered Kraft paper, which contains a sorting stage, a caustic loop and a cleaning loop for disintegrating fibers and for detaching and removing non-fiber material from the fibers. In addition to the principal functions, the method has been arranged to improve the fiber characteristics such that the recycled pulp may be used without further refining for stock preparation in supercalendered Kraft paper manufacturing.

A Method for Manufacturing Recycled Pulp from a Release Liner Supercalendered Kraft Paper Reference is made to FIG. 3. Release liner supercalendered Kraft papers share a common history of treatments. This enables to use RSCK as raw material in a recycling process, which may be arranged to produce pulp with exceptional characteristics. To obtain sufficient quality recycled pulp for a method for manufacturing supercalendered Kraft paper, the raw material used for the recycling process should contain at least 75 wt. %, more preferably at least 85 wt. %, most preferably at least 90 wt. % of release liner supercalendered Kraft paper. Advantageously the raw material used for the recycling process consists substantially of release liner supercalendered Kraft paper. A method for manufacturing recycled pulp from a release liner supercalendered Kraft paper therefore contains a step for sorting RSCK for recycling.

A method for manufacturing recycled pulp from a release liner supercalendered Kraft paper comprises a sorting stage 20 for separating RSCK apart from other papers, a first process stage, denoted as a caustic loop CL1, having a principal function of disintegrating the RSCK into pulp and detaching non-fiber material from fibers, and a second process stage, denoted as a cleaning loop NL1, having a principal function of separating pulp fibers from non-fiber material, in particular silicone particles originating from the release coating. Caustic loop CL1 provides conditions in which the pulp fibers are able to swell and fibrillate. Cured silicon-based organic polymers, polydimethylsiloxanes in particular, are generally water-resistant and relatively inert chemically. Hence, in RSCK recycling conditions, as disclosed herein, the release coating is typically fragmented into pieces, which are hereafter denoted as silicone-based particles. In addition to the principal functions, the caustic loop CL1 and the cleaning loop NL1 are configured to adjust the fibrillation of the pulp suspension, such that the recycled pulp obtained from the release liner supercalendered Kraft paper PULP3 has a pulp drainability in a range which enables the use of the recycled pulp obtained from the RSCK in a method for manufacturing supercalendered Kraft paper without further refining. The caustic loop CL1 and cleaning loop NL1 provide means to control the chemical load and temperature of the recycling process, as well as a means to adjust the consistency of the suspension.

Due to industrial use in high-speed labelling processes, RSCK may be collected in large quantities directly from an industrial user. Therefore, advantageously, the sorting of the RSCK takes place at a site where release liner REL1, REL2 is used and converted into recyclable release liner waste, for example during a labelling process. For example, polyethylene coated Kraft papers can at this point be separated and excluded from recycling. Unlike water-soluble polymers or mineral coatings, a polyethylene film does not dissolve into the suspension and is therefore challenging to recycle. Alternatively, the sorting can be performed later at a sorting unit, for instance by using visual inspection, such that release liner supercalendered Kraft paper REL1 is separated from other paper components REL2 and non-paper components. The non-paper components, to the extent possible, are rejected already prior to entering a RSCK recycling process. A non-paper component refers to an object which has typically become unintentionally part of a paper recycling process due to material handling. A non-paper component is not adhered to paper and is meant to be rejected during the recycling process. Examples of non-paper components are plastic and films components, as well as pieces of metal, glass or sand.

Sorted RSCK may be further separated based on a color shade of the paper. For example, light RSCK shades, such as white and yellow shades, may be separated from other shades. Advantageously, white RSCK grades, wherein the paper furnish does not contain colorants, are separated apart from non-white RSCK grades, such as yellow RSCK grades. A CIELAB color space may be used for measuring the colour of the RSCK and for rejecting non-light or non-white RSCK grades. A white supercalendered Kraft paper, in this context, refers to CIE L*, a*, b* colour space coordinate values of the paper, wherein L* is in the range of 92 to 98, a* is in the range of −4 to +2, and b* is in the range of +5 to +11, the values measured from a paper sample by means of diffuse reflectance method with the elimination of specular gloss, using standard illuminant D65 and 100 standard observer, in accordance with ISO 11475:2017(en). An advantage of sorting the RSCK based on a color shade of the paper is that recycled pulp obtained from RSCK may be produced without bleaching. Thus, a supercalendered Kraft paper suitable for use as a substrate of a release liner may comprise fibers from non-recycled bleached chemical pulp produced from hardwood and softwood, as well as recycled pulp obtained from supercalendered Kraft paper that has been used as a substrate of a release liner, which recycled pulp has not been bleached.

Alternatively, or in addition, the sorting can be performed mechanically, for example by using automated image analysis. An automated image analysis system may comprise, for example, a detection unit, a control unit, and sorting unit arranged to detect and separate RSCK apart from other paper products and non-paper products, based on particle shape, size and contrast. A detection unit may comprise optical instruments capable of identifying wavelengths of the visible light spectrum for detecting and identifying the colour of the paper. This may be complemented by instruments capable of identifying near infrared light, which are able to provide further information of the nature of the materials in the paper. The automated image analysis may be configured to assess paper quality based on multiple parameters, such as paper whiteness, brightness, colour shade, transparency or contrast. Pressurized air and nozzles operating on a conveyer belt may be used to separate rejected material and accepted material Advantageously, the material, after sorting, contains RSCK in the range of 75-100 wt. %, preferably in the range of 85-100 wt. %, most preferably in the range of 90-100 wt. % of the weight of the recyclable paper components. In an ideal case, the material sorted for recycling consists substantially of RSCK.

The caustic loop CL1 comprises a high consistency pulping unit 21, a screening unit 22, a cleaning unit 23 and a dewatering unit 24. The high consistency pulping unit 21 is arranged to operate in a batch mode, which facilitates the adjustment of the pulping conditions. When RSCK and clear water F1 are fed to a high consistency pulper, a pulp suspension is formed. The consistency of the pulp suspension may be adjusted by the amount of clear water F1, which may be obtained from another process. The clear water F1 may be fresh water. The consistency of the pulp suspension may be further adjusted by reusing process water F2, F3, F4 downstream from the recycling process, as needed. Process water circulated within a loop CL1, NL1 may be further used to improve the recovery of fibers within the loop CL1, NL1. For efficient disintegration of the RSCK, the consistency of the material during the pulping may be higher than 15 wt. %, preferably higher than 18 wt. %, such as in the range of 20 to 30 wt. %, advantageously in the range of 20 to 25 wt. %.

The pulping of RSCK is performed in alkaline conditions to facilitate disintegration of the cellulose fibers from the RSCK, since RSCK comprises a dense surface, a polymeric primer coating and a release coating. Advantageously, during pulping, the pH is maintained in a range between 8.5 to 10. The pH may be adjusted by addition of NaOH, referred to as caustic soda. Caustic soda reacts with the hydrogen groups of the fiber and promotes fiber swelling, referred to as caustic swelling, which will loosen the fiber network of the RSCK. Caustic soda also acts as an activator for hydrogen peroxide, which may be used to facilitate oxidative bleaching, when the pulp suspension contains colourants, for example blue colorant from a non-white grade of RSCK. Hydrogen peroxide is also used to prevent yellowing during the pulping. Typically, hydrogen peroxide is added in the range of 0.5-2 wt. %. Sodium silicate is typically added to buffer the pH of the pulp suspension and to prevent the pH of the suspension from rising excessively at the beginning of pulping. Sodium silicate thus contributes to the alkalinity of the pulp suspension, such that the conditions are suitable for the caustic swelling. Sodium silicate may be also used as a stabilising agent for the hydrogen peroxide. Sodium silicate may further improve the detachment of release liner from the fibers. Typically, sodium silicate is added in the range of 1-6 wt. %. In addition to sodium silicate, a saponifying agent, typically a fatty acid such as palmitic acid or stearic acid, is used for facilitating the detachment of silicone-based particles and other hydrophobic impurities from the fibers. Fatty acids react first with caustic soda and then with calcium ions present in the pulp suspension and form calcium soap, which is water-insoluble and finely dispersed in an aqueous phase. Soap particles, which are strongly hydrophobic, facilitate maintaining the pulped fibers and the detached hydrophobic particles, such as silicone-based particles, apart from each other in the pulp suspension. Typically, a fatty acid is used in a range of 0.1 to 1.5 wt. % of the RSCK. The fatty acid dose is advantageously matched with the water hardness, such that the amount of fatty acids is substantially equal with the amount of calcium ions present in the suspension.

Depending on the HC pulper type, the operating time of the pulping may be adjusted. The total operating time, referred to as slushing or dwell time, is generally in the range of 30 to 60 minutes, preferably at least 40 minutes, to ensure sufficient disintegration of the cellulose fibers. Typically, the temperature of a pulp suspension during pulping is at least 60° C., preferably at least 75° C., such as in the range of 60-85° C. The primer coating of the RSCK typically comprises water-soluble polymers, such as partially or fully hydrolysed polyvinyl alcohol, carboxymethyl cellulose and/or starch, which have a tendency to agglomerate at elevated temperature. While at least some of the water-soluble polymers may be dissolved during the pulping and hence filtered out during the subsequent dewatering operations, a higher pulp suspension temperature, preferably at least 75° C., promotes the agglomeration of any non-dissolved water-soluble polymers detached from the fibers. Agglomerated polymer particles from the sizing agents or release coating are easier to remove in subsequent screening and cleaning operations.

Thus, a high consistency suspension, sufficient time, temperature and chemical additives, such as hydrogen peroxide, sodium silicate (water glass) and caustic soda (NaOH), may be used to disintegrate and detach the fibers of the RSCK and induce caustic swelling, despite the hornification of the fibers.

A coarse screening unit 22, such as a disc screen having aperture size equal to or less than 4 millimeters, such as in the range of 2 to 4 millimeters, preferably in the range of 2.0 to 3.0 millimeters, most preferably in the range of 2.2 to 2.5 millimeters, is used to separate particles coming from the pulper based on their size, form and shape. The screening operates under pressure and particles passing through the aperture are accepted, while others are rejected. This enables to remove solid contaminants and non-paper components from the pulp suspension, such as sand and metal objects, as well as larger particle agglomerates.

A high-consistency cleaning unit 23, such as a cleaner using centrifugal field, is used to complement the coarse screening to separate pulp fibers from contaminants based on specific gravity. A centrifugal cleaner can remove particles down to a dimension of 10 micrometers. In addition to heavy particles such as sand and metal, a centrifugal cleaner can separate also light-weight particles present in the RSCK, such as polymer particles, release coating agglomerates or residual adhesive stickies, when their density differs sufficiently from the density of water. PVA, for example, has a density typically in the range of 1.19-1.35 g/cm$^3$ at 25° C., which differs significantly from the density of water. The separation of particles having a density closer to 1.00 g/cm$^3$, may be improved by raising the pulp suspension temperature, which decreases the density of the water. The pulp suspension temperature during the high-consistency cleaning is typically in the range of 30 to 85° C., preferably in the range of 50 to 85° C., to facilitate the cleaning of the PVA. When using a high-consistency cleaner, in general, a pulp consistency of 2-6 wt. % is used. The consistency of the pulp suspension during the cleaning may be adjusted by means of adjusting the pulping and screening conditions. The consistency of the pulp suspension may be further adjusted by reusing process water F4 downstream from the recycling process, as needed.

A dewatering unit 24 based on pressing or filtration is used to mechanically remove process water F4 from the pulp suspension and to increase the pulp consistency. Dewatering thus separates solids from a suspension. Preferably, a disk filter, a screw press or a twin-wire press is used, for efficient loop separation between the caustic loop CL1 and the cleaning loop NL1. A high consistency enables an efficient dispersion in the cleaning loop NL1, which can be used to adjust the pulp fibrillation and drainability. An efficient solid removal further enables to remove dissolved sizing agents which have not been screened or cleaned out from the pulp suspension. The pressing of the pulp suspension at the dewatering unit 24 results into a thickened pulp suspension, which comprises the fibers to be retained. Advantageously, at the end of the caustic loop CL1, the pulp suspension is thickened into a consistency equal to or higher than 20 wt. %, such as in the range of 20 to 50 wt. %, preferably in the range of 25 to 40 wt. %.

The cleaning loop NL1 comprises a dispersion unit 25, a flotation unit 26, a second screening unit 27, a washing unit 28 and a dewatering unit 29. A dispersion unit is used for producing shear forces which are sufficient for detaching remaining contaminants, such as silicone-based polymer, from the fibers and to adjust the average size of the contaminant particles to below 100 micrometers, suitable for removal by means of flotation. The dispersion unit may operate with a thickened pulp suspension received directly from the dewatering unit. The method may further comprise a dilution chest prior to the dispersion unit, for adjusting the consistency and/or temperature of the dewatered pulp suspension. Clear water F1 and/or process water F2, F3 downstream from the recycling process may be used to adjust the consistency of the dewatered pulp suspension. The process water F2, F3 downstream from the recycling process may further be used to adjust the pH of the dewatered pulp suspension. Consistency of the dewatered pulp suspension provides a means for adjusting the amount of dispersion energy applied to the pulp suspension. Advantageously, the dispersion is performed with a conical or disc disperger instead of a kneader. Unlike a kneader, a conical disperger and a disc disperger operate in conditions similar to refining. This enables an efficient and simultaneous adjustment of pulp fiber properties such that at least some of the fiber properties of RSCK fibers lost due to hornification may be compensated already during the RSCK recycling process. Thereby the recycled pulp characteristics, such as drainage and bulk, may be optimized for a method for manufacturing supercalendered Kraft paper. Conical and disc type dispergers operate in a manner where inverse correlation between pulp fibrillation and temperature exists; a lower pulp suspension temperature at the inlet correlates with a higher decrease in fibrillation. Typically, when a pulp suspension having a consistency in the range of 25 to 40 wt. % is used, the temperature of the pulp suspension at the inlet to the disperger is in the is range of 50 to 130° C., preferably in the range of 50 to 85° C. Thus, the fibrillation and drainability of the pulp can be adjusted during the dispersion by means of controlling the pulp consistency and temperature, in addition to the amount of specific energy consumed (SEC). In general, SEC in the range of 30-150 kWh/t, preferably in the range of 40-100 kWh/t, most preferably in the range of 45-90 kWh/t, may be used during the dispersion, to obtain pulp having a SR number equal to or higher than 25, such as in a range from 30 to 55, when determined according to ISO 5267-1.

A flotation unit 26 is used to remove hydrophobic particles from the pulp suspension by means of air bubbles, which collide and adhere to the particles. Clear water F1 and/or process water F2, F3 downstream from the recycling process is used for adjusting the consistency of the pulp suspension for flotation. Typically, a pulp suspension having a consistency less than 2 wt. %, such as in the range of 0.5 to 1.5 wt. %, is used for the flotation. The pulp suspension temperature during the flotation is typically in the range of 40 to 70° C. Advantageously, during flotation, the pH is maintained alkaline, in a range between 7 to 10, preferably equal to or higher than 8.5, such as in the range of 8.5 to 10. The pH may be adjusted and buffered by addition of suitable alkaline agents, such as caustic soda and sodium silicate. Soap, such as sodium soap, or other surfactant comprising a hydrophilic and a hydrophobic part, is added to act as a collector. A collector is used for promoting agglomeration of silicone particles and facilitate their charging and flotation. During flotation, a low water hardness in the range of 10-20 dH is preferred, for promoting the agglomeration further. The flotation unit 26 may contain several flotation cells arranged into a series.

A second screening unit 27 is used for fine screening to separate debris from the fibers coming from the flotation, in particular silicone particles originating from the release coating. The fine screening may use slot screens having a slot size equal to or less than 0.25 millimeters, such as in the range of 0.10 to 0.25 millimeters, preferably in the range of 0.10 to 0.20 millimeters. The screening operates under pressure and pulp suspension passing through the slots is accepted.

A washing unit 28, such as a washing unit is a belt filter type machine, is used to separate particles from the pulp suspension by size. Washing is typically performed under wire pressure with a set of two or more rolls, wherein the wire has a mesh size in the range of 36 to 60 micrometers, such that particles with a maximum size less than 30 micrometers are removed. A pulp suspension having a consistency equal to or less than 2 wt. %, such as in the range of 0.5 to 2 wt. % is typically used at the inlet of the washing unit. Clear water F1 is used to wash the filtered fiber mat and to adjust the consistency of the suspension during the washing. Dissolved contaminants are removed with the filtrate. The filtrate may be used as process water F3 upstream in the recycling process.

After washing, a second dewatering unit 29 based on pressing or filtration is used to mechanically remove process water F2 from the washed pulp suspension. Due to the relatively low consistency of the pulp after the washing unit, a twin-wire press is preferred, such that the pulp consistency may be increased efficiently for transport or storage. Advantageously, at the end of the cleaning loop NL1, the pulp suspension is thickened into a consistency equal to or higher than 30 wt. %, preferably equal to or higher than 40 wt. %, such as in the range of 30 to 50 wt. %. The recycled pulp thus obtained from release liner supercalendered Kraft paper PULP3 may then be used in a method for manufacturing supercalendered Kraft paper.

As an interim of what was disclosed above, and with reference to FIGS. 2 and 3, the recycling process 16 is arranged to contain operations and conditions, which optimize the separation of fibers from non-fiber components in the pulp suspension. Simultaneously, the caustic loop and the cleaning loop have been configured to adjust the fibrillation of the pulp suspension, such that a pulp drainability is obtained, which is in a range enabling the use of the recycled pulp obtained from the RSCK in a method for manufacturing supercalendered Kraft paper, preferably without further refining.

Hence, the recycling process 16 is arranged to improve the fiber characteristics such that the recycled pulp PULP3 may be used without further refining for preparing a stock for supercalendered Kraft paper manufacturing. The operations and conditions homogenize the pulp and develop characteristics such as pulp fibrillation, drainability and pH, which improve the quality of the pulp for a method for manufacturing supercalendered Kraft paper.

A pulp consistency in the range of 30 to 50 wt. % is advantageous in that the pulp fibers are not exposed to a further drying treatment, which may cause further hornification. A pulp consistency in the range of 30 to 50 wt. % is advantageous also when mixing the recycled pulp PULP3 together with different pulps, during stock preparation. However, when preparing recycled pulp for storage, the dewatering unit 29 may be supplemented with a drying system, such as a fluffer, to increase the dryness of the pulp, such that a pulp consistency equal to or higher than 80, such as in the range of 80 to 90 wt. % is obtained.

Properties of Recycled Pulp Obtained from Supercalendered Kraft Paper that has been Used as a Substrate of a Release Liner Referring to above, recycled pulp obtained from RSCK has a pH which is typically neutral or alkaline, when determined from aqueous pulp extracts. An alkaline pH during the recycling is preferred, as a higher pH softens the pulp and facilitates the flotation. Alkalinity of the pulp also facilitates the modification of pulp fibrillation and drainability. Recycled pulp obtained from RSCK, when having alkaline pH, needs less energy for refining. The pH, however, may be adjusted, as necessary, prior to using the recycled pulp.

Recycled pulp obtained from RSCK is distinguished from non-recycled BCP due to the extent of hornification of the fibers. This can be measured, for instance, by water retention value, abbreviated as WRV, according to ISO 23714:2014 (en). WRV is an empirical measure of the capacity of a pulp sample to hold water. Typically, the WRV of recycled pulp obtained from RSCK is low, such as in the range of 1.3 to 1.6 g/g.

Recycled pulp obtained from RSCK is also distinguished by its water drainage resistance, which is a measure of pulp fibrillation, and which may be determined by the Schopper-Riegler test. The SR number is a measure of the extent of fibrillation in the recycled pulp PULP3. The recycled pulp obtained from RSCK may have a SR number equal to or higher than 25, such as in a range from 25 to 65, when determined according to ISO 5267-1. Typically, recycled pulp obtained from RSCK has a SR number equal to or higher than 30, if the aqueous extract, from which the measurement is performed, is process water that contains electrolytes. When measuring the water drainage resistance from dry pulp with standard water in accordance with ISO 5267-1, in conjunction with ISO 14487, the SR number may be higher, such as equal to or higher than 40, since the concentration of electrolytes (salts) in a pulp suspension influences the drainability. Regardless of the initial SR number, upon refining the SR number of the recycled pulp obtained from RSCK develops very quickly. This is a feature of recycled pulp obtained from RSCK, which may be used to distinguish it from other non-recycled pulp components used in a supercalendered Kraft paper. Table 1 (below) demonstrates, by means of an example, the development of SR number (° SR) in recycled pulp obtained from RSCK, as a function of specific energy consumption (SEC) in kWh/t. In the example, a specific edge load (SEL) of 0.3 J/m was applied, using Voith-Sulzer laboratory refiner having 40D hardwood plates. Prior to refining, the recycled pulp obtained from RSCK presented a SR number of 32.

TABLE 1

Development of SR in the recycled pulp obtained from RSCK, as a function of SEC (kWh/t).

| SEC (kWh/t) | °SR |
|---|---|
| 0 | 32 |
| 10 | 37 |
| 20 | 43 |
| 30 | 48 |
| 40 | 54 |
| 50 | 58 |
| 60 | 63 |
| 70 | 67 |

Advantageously, prior to the mixing in a method for manufacturing supercalendered Kraft paper, the recycled pulp obtained from supercalendered Kraft paper that has been used as a substrate of a release liner has a ° SR equal to or higher than 25, such as in a range from 25 to 65, preferably in the range of 30 to 60, most preferably in the range of 40 to 55, when determined according to ISO 5267-1.

Advantageously, when using the recycled pulp obtained from RSCK in a method for manufacturing supercalendered Kraft paper suitable for use as a substrate of a release liner, the recycled pulp obtained from supercalendered Kraft paper that has been used as a substrate of a release liner has a pH which is in the range of 6.0 to 9.1. Preferably the pH is slightly alkaline, such as in the range of 7.0 to 8.5. A recycled pulp obtained from supercalendered Kraft paper that has been used as a substrate of a release liner having an alkaline pH requires less energy for refining of the fibers. A highly alkaline pH may inhibit the functioning of cationic UV curing silicone systems. Most preferably, the pH in the range of 7.5 to 8.2, whereby the drying and the compatibility of the recycled pulp can be optimized for supercalendered Kraft paper production. When determining the pH of dried pulp samples, standard ISO 6588-2 (2020) may be used. When determining the pH of pulp suspension samples from a paper machine, the pH may be measured either directly from the pulp sample (when the consistency is 5 wt. % or less) or from a filtrate (when the consistency is higher than 5 wt. %). A filtrate, as used herein, refers to an aqueous extract. When determining the pH from dry pulp, an amount of 2 grams of dry pulp is cut into pieces, such that each piece has a maximum dimension of 1 centimetre. The cut pieces are mixed with 100 millilitres of deionised water to disperse the pulp with the water such that a suspension having a pulp concentration of 2 wt.-% of water is obtained. The sample thus obtained is heated to a boiling point and boiled for 60 minutes. After boiling, the sample is cooled down, such that the temperature of the sample is in the range of 20 to 25° C., and the sample is filtrated through a filter having a 200 mesh grid, for example by means of a Buchner-funnel, thereby obtaining a filtrate separated from the pulp. The pH is measured from the filtrate thus obtained.

The pulp pH is measured from an aqueous extract having a temperature in the range of 20 to 25° C., by means of a pH meter, using two buffer solutions having pH 4 and pH 7, respectively. Suitable pH meters are, for example, pH-meter CG 840 with electrode N 1042A, Knick pH-meter 766 Calimatic with electrode SE 103 or Mettler-Toledo MP 120, used according to the manufacturer's instructions.

When manufacturing recycled pulp from a release liner supercalendered Kraft paper as disclosed above, the removal of silicone-based particles is not complete. The recycled pulp obtained from RSCK still contains traces of the cured release coating, in very small size particles, which are chemically rather inert. The maximum particle size of the silicone-based particles is typically in the range of 100 to 150 micrometers and limited by the slot size used in the fine screening in the cleaning loop NL1. While detectable, the amount of silicone-based particles in the recycled pulp obtained from RSCK has not been observed to cause difficulties, upon manufacturing supercalendered Kraft paper on a paper machine. The amount of silicone-based particles may be measured with an Energy Dispersive X-ray Spectroscopy from a test specimen which is combusted at 900° C., in accordance with Tappi standard T 413, which detects the oxides of silicon. Typically, a supercalendered Kraft paper comprising recycled pulp from RSCK contains silicon in an amount of equal to or less than 0.3 wt. %, preferably equal to or less than 0.28 wt. %, most preferably equal to or higher than 0.25 wt. %, such as in the range of 0.01 to 0.3 wt. %, determinable as dry matter content from a paper specimen which is combusted at 900° C. with an Energy Dispersive X-ray Spectroscopy, in accordance with Tappi standard T 413.

EXPERIMENTAL STUDIES

Reference is made to FIGS. 4-11. Experimental studies were prepared to assess the characteristics of the recycled pulp obtained from RSCK and to determine its effects in a method for manufacturing supercalendered Kraft paper.

Experimental Study 1

In a first experimental study, pulp properties of recycled pulp obtained from RSCK were measured and compared to properties of non-recycled bleached chemical pulps and mill broke used at a paper mill for supercalendered Kraft paper production. Below are listed the pulp types and their abbreviation in the experimental study:

BCP SW northern bleached softwood kraft pulp (coniferous trees)

BCP HW bleached hardwood kraft pulp (eucalyptus)

BCP SW rf. mill refined BCP SW (SEC 240 kWh/t)

BCP HW rf. mill refined BCP HW (SEC 135 kWh/t)

mill broke mill broke obtained from supercalendered Kraft paper production

PULP3 recycled pulp obtained from RSCK

The consistency of the pulps in the study was 4 wt. %. The properties of the non-recycled bleached chemical pulps were measured before and after refining, to compare the properties of the recycled RSCK and the non-recycled bleached chemical pulps.

Pulp Analyses

The pH of the pulps disclosed above were measured from aqueous pulp extracts according to ISO 6588-2 (2020). The results are shown in Table 2 (below).

TABLE 2

Measured pH of pulp samples.

| Sample | pH |
|---|---|
| BCP SW | 5.3 |
| BCP HW | 5.1 |
| PULP3 | 6.8 |
| mill broke | 5.3 |

The results represent an average of measurements, during which the recycled pulp obtained from RSCK varied in the range of 6.8 to 7.3. The measured pH in the recycled pulp obtained from RSCK was clearly higher than in the non-recycled chemical pulps made of softwood or hardwood. The measured pH in the recycled pulp obtained from RSCK was clearly higher than in the mill broke, as well.

Pulps as disclosed above were further analysed by means of a fiber furnish analysis according to ISO standards ISO 9184-1 and 9184-4:1990. A fiber furnish analysis is capable to identify papermaking fibers from a sample. The analysis may further be used to quantify average dimensions of the different fiber types detected in a sample. The wood species used in a pulp may be distinguished by comparison method, wherein a sample fiber is compared against a known reference fiber. Valmet Fiber Image Analyzer (Valmet FS5) is an example of a device, which can be used according to the manufacturer's instructions to perform the fiber furnish analysis. For example, automated optical analysis, such as an ultra high resolution (UHD) camera system equipped with image analysis software, may be used to acquire a greyscale image of a sample, of which image the properties of the fibers in the sample may be determined. The greyscale image may be acquired from a sample placed in a transparent sample holder, such as a cuvette, using a 0.5 millimetre depth of focus according to ISO 16505-2 standard. Valmet Fiber Image Analyzer (Valmet FS5) may further be used to determine fiber dimensions, such as fiber length and fiber width, as well as length weighted distribution of the pulp fibers, by means of automated optical analysis using unpolarized light, according to ISO 16065-2: 2014.

Figure 4:
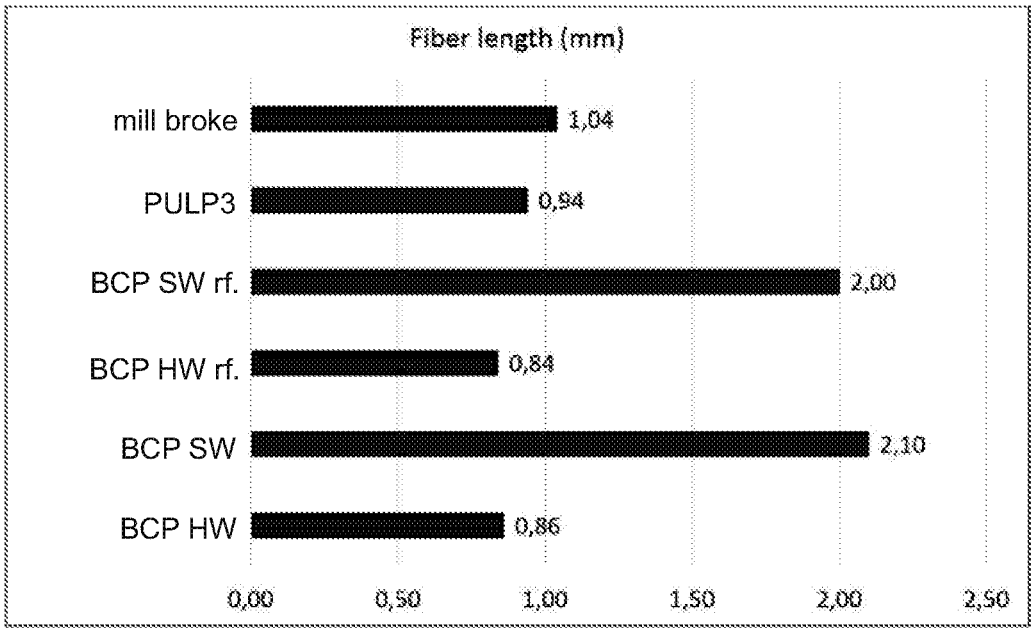
FIG. 4 shows comparative data of average length in millimeters of fibers in recycled pulp obtained from RSCK vs. non-recycled pulp types, measured using a Valmet Fiber Image Analyzer (Valmet FS5).

Reference is made to FIG. 4, which shows the average length in millimeters of fibers in recycled pulp obtained from RSCK and other pulp types, measured as length weighted average fiber length, using a Valmet Fiber Image Analyzer (Valmet FS5). The recycled pulp obtained from RSCK comprises an average fiber length of 0.94 millimeters. The non-recycled BCP made of hardwood comprises an average fiber length of 0.86 millimeters, which upon refining was reduced to 0.84 millimeters. Hence, the average fiber length of recycled pulp obtained from RSCK is higher than the average fiber length of non-recycled BCP made of hardwood. The non-recycled BCP made of softwood comprises an average fiber length of 2.10 millimeters, which upon refining was reduced to 2.00 millimeters. Hence, the average fiber length of recycled pulp obtained from RSCK is significantly less than the average fiber length of non-recycled BCP made of softwood. Mill broke had an average fiber length of 1.04 millimeters.

Figure 5:
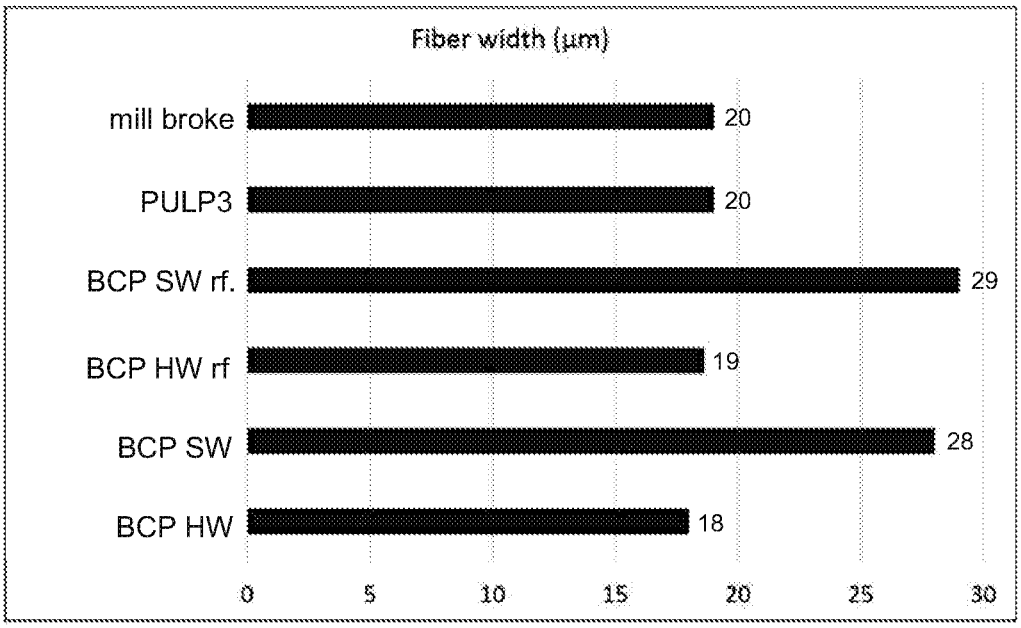
FIG. 5 shows comparative data of average fiber width in micrometers of fibers in recycled pulp obtained from RSCK vs. non-recycled pulp types, measured using the Valmet Fiber Image Analyzer (Valmet FS5).

Reference is further made to FIG. 5, which shows comparative data of average fiber width in micrometers of fibers in recycled pulp obtained from RSCK and other pulp types, measured, using the Valmet Fiber Image Analyzer (Valmet FS5). The recycled pulp obtained from RSCK comprises an average fiber width of 20 micrometers. The non-recycled BCP made of hardwood comprises an average fiber width of 18 micrometers, which upon refining was increased to 19 micrometers. Hence, the average fiber width of recycled pulp obtained from RSCK is larger than the average fiber width of non-recycled BCP made of hardwood. The non-recycled BCP made of softwood comprises an average fiber width of 28 micrometers, which upon refining was increased to 29 micrometers. Hence, the average fiber width of recycled pulp obtained from RSCK is significantly less than the average fiber width of non-recycled BCP made of softwood. Mill broke had an average fiber width of 20 micrometers.

Hence, the average fiber length and width of recycled pulp obtained from RSCK is closer to the average fiber length of non-recycled BCP made of hardwood or broke, but clearly distinguished from the average fiber length of non-recycled BCP made of softwood.

The length weighted distribution of the pulp fibers was further analysed using Valmet Fiber Image Analyzer (Valmet FS5), according to the manufacturer's instructions. In the analysis, fibers were defined to be the fraction of the pulp that included particles having a width in the range of 10 to 75 micrometers and a length in the range of 0.2 to 7.0 millimeters. Fines were defined to be the fraction of the pulp that included particles having a width in the range of 10 to 75 micrometers and a length less than 0.2 millimeters. Fibrils were defined to be the fraction of the pulp that included particles having a width less than 10 micrometers and a length longer than 0.2 millimeters. Flakes were defined to be the fraction of the pulp that included particles having a width less than 200 micrometers and a length less than 0.2 millimeters. Fibrils are typically particles generated from the secondary wall of the wood cell layer structure, which due to their elongated shape may improve bonding properties of the pulp. Flakes are typically particles generated from the middle lamella and primary wall of the wood cell layer structure, which tend to decrease the bonding properties of the pulp. The flakes scatter light and may hence affect the optical properties of the pulp by increasing opacity and decreasing transparency.

The content of fines in a bleached chemical pulp, such as bleached kraft pulp, varies naturally depending on the used wood species. The content of the fines in a pulp varies also due to pulp treatments, such as refining and recycling, as disclosed above. The length weighted distribution of fines is a fundamental property of pulp, which affects inter alia the formation of paper web during manufacturing. The pulp characteristics also have an effect on the tensile strength, the burst strength, the fold endurance and the tear resistance of a paper.

The results of the analysis was, that the amount of fines in the recycled pulp obtained from RSCK was 16.3% of the total amount of fibers in the recycled pulp, when determined as length weighted average fiber length, by means of an automated optical analysis using unpolarized light according to ISO 16065-2:2014. The amount of fines in the recycled pulp obtained from RSCK was in the same level as in the mill refined non-recycled bleached chemical pulp made of hardwood. The amount of fibrils in the recycled pulp obtained from RSCK, unexpectedly, was much higher than in the mill refined non-recycled bleached chemical pulp made of hardwood, but lower than in the mill refined non-recycled bleached chemical pulp made of softwood. The results demonstrate that the recycled pulp obtained from supercalendered Kraft paper that has been used as a substrate of a release liner contains particles derived from the recycled pulp having a length less than 200 micrometers in an amount equal to or higher than 10%, such as in a range from 10 to 30%, preferably in the range of 12 to 20%, most preferably in the range of 15 to 17%.

The Valmet Fiber Image Analyzer also provided results of the amount fiber deformations, such as fiber kinks and fiber curl, in the pulps. Fiber kinks and curls tend to decrease the tensile strength of the formed paper, due to reduced bonding ability of the fibers in a fiber network. Of notice, the number of kinks in the recycled pulp obtained from RSCK was 3250 1/m, which was considerably higher than in the non-recycled bleached chemical pulps after refining or in the mill broke. The number of kinks in the non-recycled bleached chemical pulp made of hardwood was 2880 1/m before refining and 2310 1/m after refining. The number of kinks in the non-recycled bleached chemical pulp made of softwood was 3410 1/m before refining and 2730 1/m after refining.

Measured fiber analysis results of recycled pulp obtained from RSCK, non-recycled bleached chemical pulps (before and after mill refining) and mill broke used at a paper mill for supercalendered Kraft paper production in the experimental study are presented in Table 3 (below). Comparison of the samples demonstrates that the fiber characteristics and the relative amount of fiber fractions is different in the recycled pulp obtained from RSCK.

TABLE 3

Fiber analysis results and properties of recycled pulp obtained from RSCK (PULP3), non-recycled bleached chemical pulps (before and after mill refining) and mill broke used at a paper mill for supercalendered Kraft paper production.

| Sample | Fiber length (mm) | Fiber width (μm) | Fines (%) | Flakes (%) | Fibrils (%) | Kinks (1/m) | Curl (%) | °SR | WRV (g/g) |
|---|---|---|---|---|---|---|---|---|---|
| BCP SW | 2.10 | 28 | 15.0 | 12 | 1.9 | 3410 | 16 | 13 | 1.1 |
| BCP HW | 0.86 | 18 | 14.0 | 15 | 0.3 | 2880 | 10 | 18 | 1.2 |

TABLE 3-continued

Fiber analysis results and properties of recycled pulp obtained from RSCK (PULP3), non-recycled bleached chemical pulps (before and after mill refining) and mill broke used at a paper mill for supercalendered Kraft paper production.

| Sample | Fiber length (mm) | Fiber width (μm) | Fines (%) | Flakes (%) | Fibrils (%) | Kinks (1/m) | Curl (%) | °SR | WRV (g/g) |
|---|---|---|---|---|---|---|---|---|---|
| BCP SW rf. | 2.00 | 29 | 20.5 | 20 | 7.5 | 2730 | 15 | 32 | 1.9 |
| BCP HW rf. | 0.84 | 19 | 16.3 | 18 | 0.6 | 2310 | 8 | 52 | 1.9 |
| PULP3 | 0.94 | 20 | 16.3 | 19 | 3.9 | 3250 | 10 | 43 | 1.5 |
| mill broke | 1.04 | 20 | 20.5 | 24 | 2.8 | 2650 | 10 | 53 | 1.6 |

Figure 6:
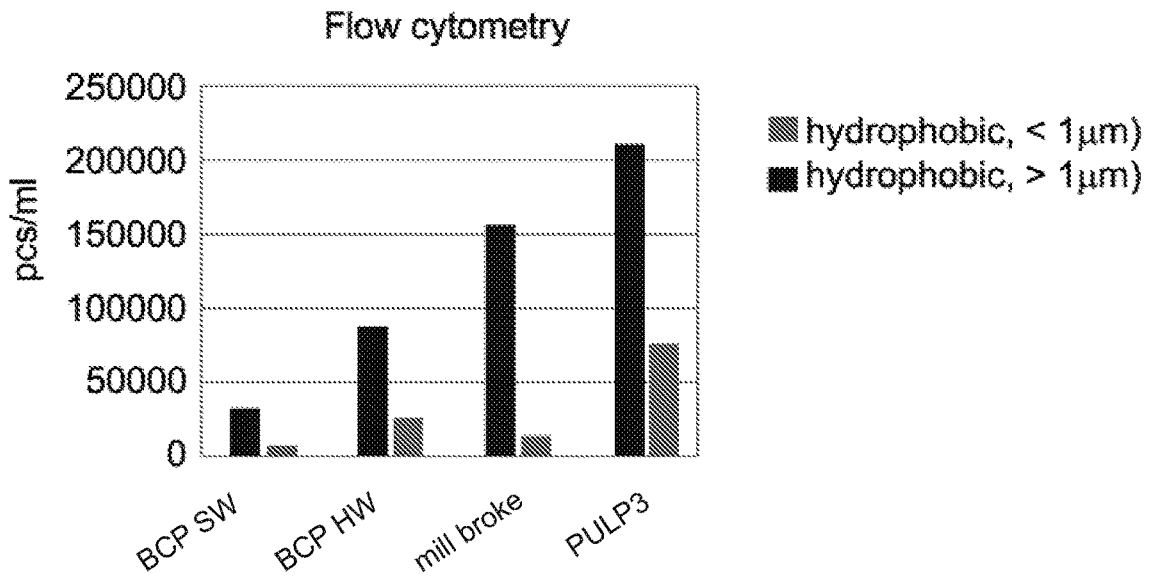
FIG. 6 shows comparative data of the average amount of hydrophobic particles in different pulp types, when measured by means of flow cytometry. The particles have been further sorted based on an average diameter.

Reference is made to FIG. 6. The pulps as disclosed above were further analysed on the basis of the hydrophobic nature of the pulp. The hydrophobicity of the particles in the pulp was measured by means of flow cytometry, which is a well-known analytical method for counting, identifying and sorting particles based on selected characteristics. A Sysmex CyFlow Cube 6 (V2m) bench-top flow cytometer was used for the analysis. Representative samples of 20 ml were collected from the paper machine and diluted with ultrapure water 5-fold and the diluted and well mixed sample was then filtered through a 200 mesh screen. A 50 ml aliquot of the filtrate was collected for further dilution. A series of dilutions (in the range of 10-1000 fold) was prepared with ultrapure water such that a suitable dilution was obtained, which contained particles in an amount that resulted into 700-1000 events per second, when analysed with the flow cytometer. A volume on 20 ml of the dilution to be analysed was mixed with 1 ml of Nile red stain, which was used as a fluorescent marker to selectively stain hydrophobic moieties in the samples. Prior to analyzing the samples, the flow cytometry was calibrated to size standards with 3 μm commercial polystyrene beads. Relative hydrophobicity (>10) was used for gating the particles. The particles in each sample were further sorted based on their size, such that hydrophobic particles with a diameter of 1 micrometer or less was denoted as small, whereas hydrophobic particles with a diameter over 1 micrometer were denoted as large. The results indicate that the recycled pulp obtained from RSCK contains in the range of 2-3 times higher amount of large and small hydrophobic particles than non-recycled BCP made of hardwood. The recycled pulp obtained from RSCK contains close to 10 times higher amount of large and small hydrophobic particles than non-recycled BCP made of softwood. The difference to mill broke was also clear. While most of the hydrophobic particles in all of the analysed samples belonged to the group of large particles, that is, over 1 micrometer in diameter, the highest relative difference between the recycled pulp obtained from RSCK and other pulp types was measured in the group of small particles. The amount of hydrophobic particles in a sample, in units of pieces per millilitre (pcs/ml) and the total measured particle amount in the samples (pcs) is shown in Table 4 (below).

TABLE 4

Amount of hydrophobic particles and total particle amount in samples measured by flow cytometry.

| Sample | Hydrophobic particles (pcs/ml) | Total particle amount (pcs) |
|---|---|---|
| BCP SW | 39000 | 2400000 |
| BCP HW | 110000 | 6000000 |

TABLE 4-continued

Amount of hydrophobic particles and total particle amount in samples measured by flow cytometry.

| Sample | Hydrophobic particles (pcs/ml) | Total particle amount (pcs) |
|---|---|---|
| PULP3 | 310000 | 8400000 |
| mill broke | 170000 | 14000000 |

It was contemplated that the observed increase of hydrophobic particles, particularly small hydrophobic particles, in the recycled pulp obtained from RSCK, would be due to silicone polymer residues form the release coating. However, despite the amount of hydrophobic particles in the recycled pulp obtained from RSCK, no detectable problems were observed upon supercalendered Kraft paper production in the experiments, with respect to runnability or paper quality.

Experimental Study 2

In a second experimental study, supercalendered Kraft paper having grammage of 53 g/m$^2$ and a thickness of 48 μm was produced, such that the amount of recycled pulp obtained from RSCK in the stock was varied. The amount of recycled pulp obtained from RSCK was varied from 0 to 30 wt. %, referring to the dry matter content of the produced supercalendered Kraft paper, according to SCAN-P 39:80. The ratio of non-recycled bleached chemical pulp produced from hardwood to the non-recycled bleached chemical pulp produced from softwood was maintained constant. Hence, the non-recycled BCP contained 35 wt. % of non-recycled BCP produced from softwood and 65 wt. % of non-recycled BCP produced from hardwood. Thus, upon increasing the amount of recycled pulp obtained from RSCK in the stock, the amount of BCP was decreased such that the share of non-recycled BCP produced from hardwood to softwood was maintained. The amount of broke was maintained the same, 12 wt. %, in all experiments.

Samples were measured at various trial points. A composition, which contained only non-recycled bleached chemical pulps and broke, but did not contain recycled pulp obtained from RSCK, is marked in the FIGS. 7-11 as a reference point, and abbreviated as REF. A composition, which contained 15 wt. % of recycled pulp obtained from RSCK, is marked in the FIGS. 7-11 as a trial point 1, and abbreviated as TP1. A composition, which contained 30 wt. % of recycled pulp obtained from RSCK, is marked in the FIGS. 7-11 as a trial point 2, and abbreviated as TP2. The stock composition of the reference point and trial points 1 and 2, is described in Table 5 (below).

TABLE 5

Composition of stock at reference and trial points 1 and 2 in experimental studies. The abbreviation 'BCP tot.' refers to the total amount of non-recycled bleached chemical pulp in the stock, in wt. %. Broke refers to the amount of mill broke wt. % in the stock, in wt. %. PULP3 refers to the amount of recycled pulp obtained from RSCK in the stock, in wt. %. The last column on the right refers to the share of each component (BCP SW, BCP HW, broke, PULP3) in the stock, which sums up to 100 wt. %.

| Sample | BCP tot. (wt. %) | broke (wt. %) | PULP3 (wt. %) | BCP SW/BCP HW/broke/PULP3 (wt. %) |
|---|---|---|---|---|
| REF | 88% | 12% | 0% | 31/57/12/0 |
| TP1 | 73% | 12% | 15% | 26/47/12/15 |
| TP2 | 58% | 12% | 30% | 20/38/12/30 |

Fines Content at the Machine Chest (BMN Method)

Figure 7:
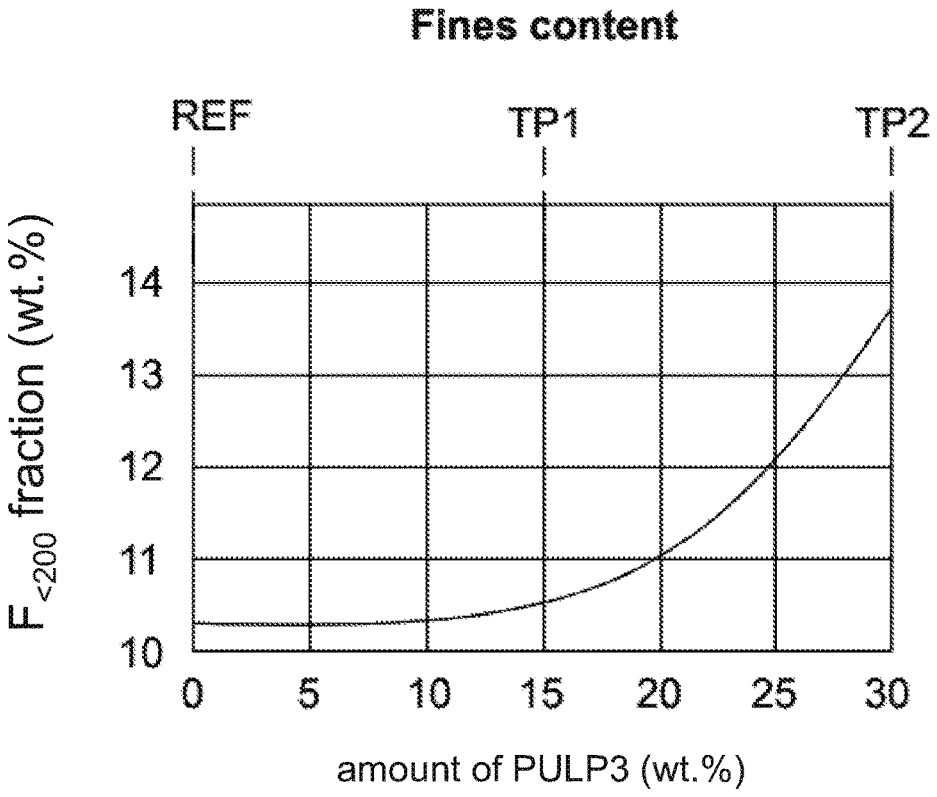
FIG. 7 is a trend diagram representing the development of fines content at the machine chest of a paper machine as a function of the amount of recycled pulp obtained from RSCK in the stock, when determined as the $F_{<200}$ fraction with McNett classifier according to SCAN-CM 6:05.

Reference is made to FIG. 7. The effect of the recycled pulp obtained from RSCK on supercalendered Kraft paper production was assessed by measuring the development of fines content at the machine chest of a paper machine as a function of the amount of recycled pulp obtained from RSCK in the stock. The fines content, in this context, refers to fibrous material in the pulp that was determined as the $F_{<200}$ fraction with McNett classifier according to SCAN-CM 6:05, using a 20 minutes fractionation time, a set of 16, 28, 48 and 200 mesh wires, and weighed filter papers (Macherey-Nagel MN616, 125 mm diameter) for collecting the fibre fractions. The method describes a fibre-fractionation procedure, wherein the fibres in a pulp suspension are grouped into fractions of different average fibre size. The mass of the fibres retained in a fraction is expressed as a percentage of the dry mass of the original sample. The retained $F_{<200}$ fraction serves as an indication of how much the fines content changes in supercalendered Kraft paper production due to an increase in the amount of pulp obtained from RSCK, when the relative ratio of the BCP SW and BCP SW is maintained, the amount of broke mill staying the same. The results evidence that when the amount of recycled pulp obtained from RSCK in the supercalendered Kraft paper is in the range of 0 to 10 wt. %, the fines content remains relatively stable, in the range of 10.2 wt. % to 10.5 wt. %. However, unexpectedly, when the amount of recycled pulp obtained from RSCK in the supercalendered Kraft paper is equal to or higher than 10 wt. %, the fines content begins to increase more rapidly. In particular, when the amount of recycled pulp obtained from RSCK in the supercalendered Kraft paper is equal to or higher than 15 wt. %, such as in the range of 15 to 30 wt. %, the fines content in the fiber furnish of the supercalendered Kraft paper increases very rapidly. During the experiment, when the amount of recycled pulp obtained from RSCK in the supercalendered Kraft paper was in the range of 0 to 30 wt. %, the fines content increased from 10.2 wt. % to 13.8 wt. %. The fines content had an effect to the characteristics of the paper. The effect was detectable already upon forming the paper web. The results indicate that the amount of recycled pulp obtained from RSCK in the stock may be used for adjusting the retention level, which describes the ability of the formed paper web to retain fine particles on the web, and therefore the balance between drainage and formation of the paper web.

Water Retention Value at the Machine Chest

Figure 8:
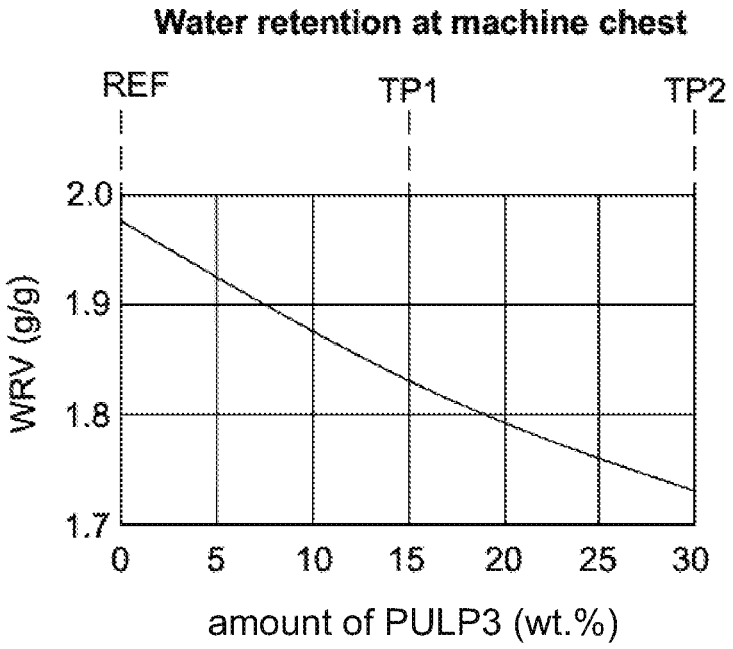
FIG. 8 is a trend diagram representing the development of water retention value as a function of pulp content, at machine chest of a paper machine. The content of recycled pulp obtained from RSCK correlates inversely with the water retention value. When the content of recycled pulp obtained from RSCK increases, the water retention value decreases.

Reference is made to FIG. 8. The effect of the recycled pulp obtained from RSCK on supercalendered Kraft paper production was further assessed by measuring the water retention value, abbreviated as WRV, at the machine chest according to ISO 23714:2014(en). The WRV was determined as an average of two parallel samples, each sample amount consisting of 1 g of dry pulp diluted into 500 ml of water and having a temperature of 23±3° C. Materials and methods as listed below were used:

Beckman Coulter Avanti J-301 laboratory centrifuge

Centrifugal force of 3000 g±50 g, 30 minutes

JS 7.5 rotor (speed 5350; RPM 5289)

The sample was weighed first time after the centrifugation. The sample was then dried overnight (12 h) at 105±2° C. and cooled down to a room temperature of 23±3° C. in an excicator. The sample was then weighed a second time. A laboratory scale (0.0001 g precision) was used for the weighing.

The water retention value was calculated according to equation 1 below:

$$WRV = \frac{m1}{m2} - 1, \qquad \text{Equation 1}$$

wherein m1=mass of sample after centrifugation, in grams m2=mass of sample after drying, in grams.

The results evidence that a replacement of non-recycled BCP with recycled pulp obtained from RSCK leads to a steady decrease in the water retention value, which is inversely proportional to the amount of the recycled pulp obtained from RSCK in the supercalendered Kraft paper. Each replacement of 10 wt. % of non-recycled BCP by recycled pulp obtained from RSCK results into a WRV decrease in the range of 0.1 g/g in the supercalendered Kraft paper. The decrease in the WRV was evidenced over the whole range. At the reference point, the WRV was 1.98 g/g. At the trial point 1, the WRV was 1.83 g/g. At the trial point 2, the WRV was 1.72 g/g. The water retention level analysis results support and validate the observations of the fines content analysis disclosed above. The correlation of WRV as a function of the amount of recycled pulp obtained from RSCK in the stock demonstrates that recycled pulp obtained from RSCK in the stock may be used for adjusting the water retention level. The lower WRV of the fibers in the recycled pulp obtained from RSCK, compared to the fibers in the non-recycled BCP, is advantageous upon drying. A reduced amount of water absorbed into the fiber network at the machine chest indicates a better dimensional stability of the paper upon drying. Thus, considering the trend of development of the fines content and the drainage discussed hereafter, the supercalendered Kraft paper advantageously contains recycled pulp obtained from supercalendered Kraft paper that has been used as a substrate of a release liner equal to or less than 50 wt. %, such as in the range of 5 to 50 wt. %, preferably in the range of 10 to 45 wt. %, most preferably in the range of 15 to 40 wt. % of the paper, when determined as dry matter content according to SCAN-P 39:80. Further, the stock at a machine chest of a paper machine has a water retention value which is in the range of 1.5 to 1.9 g/g, preferably in the range of 1.55 to 1.85, most preferably in the range of 1.6 to 1.8, determinable according to ISO 23714:2014 from a sample having a dry matter content of 1 gram.

Paper Drainage—Main Steam Group Pressure at the Drving Section

Figure 9:
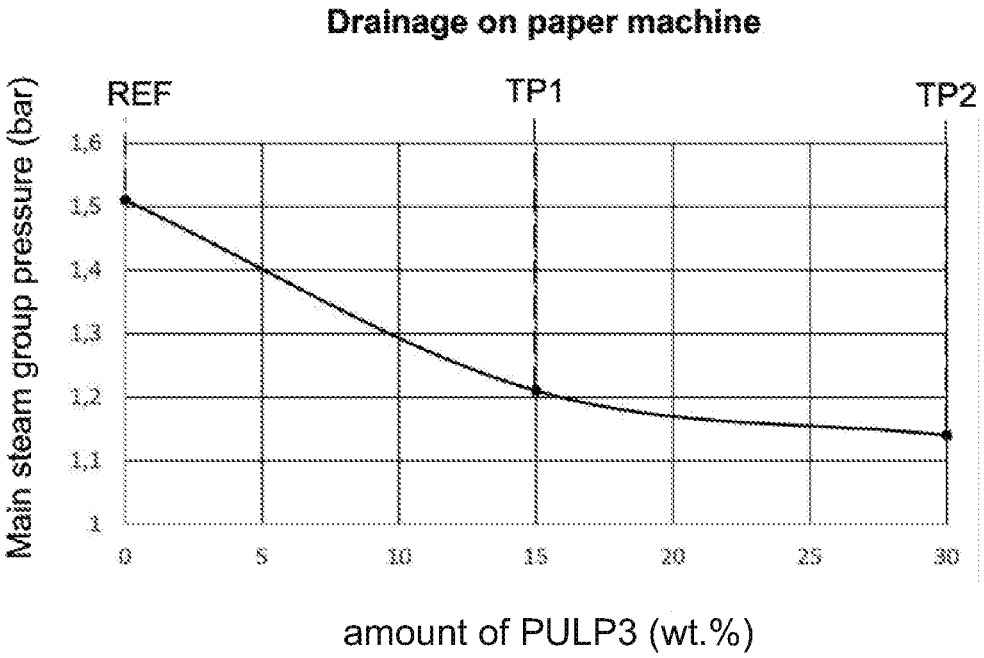
FIG. 9 is a trend diagram representing the drainage as a function of pulp content, when measured as the main steam group pressure level on a paper machine. The addition of recycled pulp obtained from RSCK reduces the need for steam in the pre-dryer.

Reference is made to FIG. 9. The effect of the recycled pulp obtained from RSCK on supercalendered Kraft paper production was next assessed by measuring the main steam group pressure at a paper machine during supercalendered Kraft paper production. The main steam group pressure is an indication of the drainage and direct evidence of the amount of energy consumed, when drying the paper. The results evidence that the drainage improves, when the amount of recycled pulp obtained from RSCK in the supercalendered Kraft paper increases. The formed supercalendered Kraft paper had a higher dry matter content. Further, a supercalendered Kraft paper comprising a higher amount of recycled pulp obtained from RSCK needed less steam pressure for drying. Unexpectedly, the drainage, when measured by means of the main steam group pressure, seemed to be most effective, when the amount of recycled pulp obtained from RSCK in the supercalendered Kraft paper was equal to or less than 15 wt. %, such as in the range of 5 to 15 wt. %. Already an amount of 5 wt. % of recycled pulp obtained from RSCK in the composition required 0.1 bar less of steam pressure for drying the supercalendered Kraft paper, as evidenced by FIG. 9. An amount of 15 wt. % of recycled pulp obtained from RSCK in the composition required 0.3 bar less of steam pressure for drying the supercalendered Kraft paper.

Paper Cross-Directional Profiling at the Reeler

The effect of the recycled pulp obtained from RSCK on supercalendered Kraft paper production was further evaluated at the drying section. The supercalendered Kraft paper samples demonstrated a density in the range of 1100±11 g/m$^3$ and a transparency in the range of 50±1%. The characteristics of samples produced according to the reference and trial points compositions are presented in Table 6 (below). The trial points were run with the same speed and settings for all the compositions (REF, TP1, TP2), such that the effect of recycled pulp obtained from RSCK to the supercalendered Kraft paper could be evaluated.

TABLE 6

Characteristics of supercalendered Kraft paper samples.

| Sample | Grammage (g/m$^2$) | Thickness (μm) | Density (g/m$^3$) | Transparency (%) |
|---|---|---|---|---|
| REF | 53.01 | 48.431 | 1098.0 | 50.27 |
| TP1 | 52.85 | 48.227 | 1110.2 | 49.86 |
| TP2 | 53.32 | 48.262 | 1099.8 | 49.25 |

The results indicate that recycled pulp obtained from RSCK enables to maintain quality characteristics of supercalendered Kraft paper, such as density and transparency, at a sufficient level. The combination of preserved density and transparency serves as an indirect indicator of this.

Figure 10:
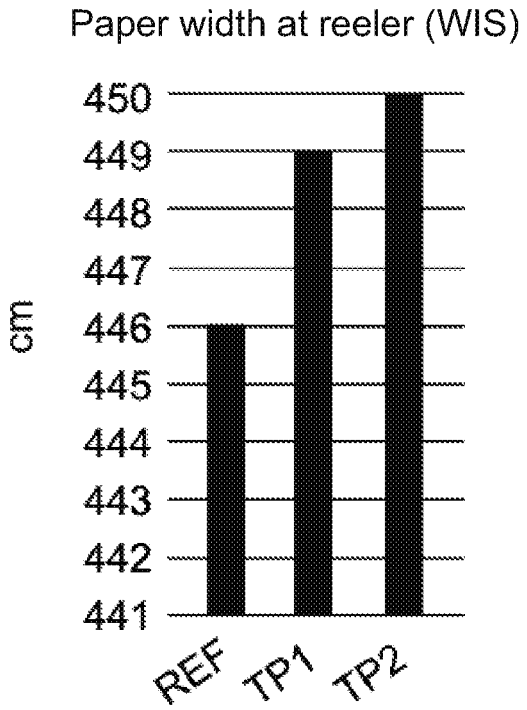
FIG. 10 shows comparative data of the development of paper width in centimetres at the reeler of a paper machine, when measured using ABB Web Imaging System (WIS). The results demonstrate that paper shrinkage in the cross-direction $S_y$ correlates inversely with the amount of recycled pulp obtained from RSCK in the paper.

Reference is made to FIG. 10. The paper width was measured from supercalendered Kraft paper samples at the reference point, trial point 1 and trial point 2. The paper width was measured at the reeler, in centimeters, by means of Web Imaging System, abbreviated as WIS, which is an automated image analysis system provided by ABB. The system was used according to manufacturer's instructions. The width of the paper indicated in FIG. 10 is an average value of 8 measurements along the surface of the paper in the cross-direction $S_y$, which is perpendicular to the machine direction $S_x$. The results evidence that a replacement of non-recycled BCP with recycled pulp obtained from RSCK leads to reduced shrinkage of the supercalendered Kraft paper, which is directly proportional to the amount of the recycled pulp obtained from RSCK in the supercalendered Kraft paper. A replacement of 15 wt. % of non-recycled BCP by recycled pulp obtained from RSCK resulted into a supercalendered Kraft paper, which demonstrated 3 cm less shrinkage than the reference. A replacement of 30 wt. % of non-recycled BCP by recycled pulp obtained from RSCK resulted into a supercalendered Kraft paper, which demonstrated 4 cm less shrinkage than the reference. The WIS results were validated in an independent trial run, wherein the paper was profiled off-line from 30 calendered and uncalendered paper samples at the reeler, by means of a Tapio PMA, which is an automated paper quality control system provided by Tapio technologies. The system was used according to manufacturer's instructions. The results of the latter independent trial run with Tapio PMA validated the paper width results of the first trial run. In samples without recycled pulp obtained from RSCK (REF), the measured shrinkage along the surface of the paper in the cross-direction $S_y$ was 3.6%. In samples containing 15 wt. % of recycled pulp obtained from RSCK (TP1), the measured shrinkage along the surface of the paper in the cross-direction $S_y$ was 3.0%. In samples containing 30 wt. % of recycled pulp obtained from RSCK (TP2), the measured shrinkage along the surface of the paper in the cross-direction $S_y$ was 2.9%. During the latter trial run, also the grammage and thickness variability of the uncalendered paper along the surface of the paper in the cross-direction $S_y$ was simultaneously determined from the 30 paper samples by means of the Tapio PMA, according to the manufacturer's instructions. The grammage variability analysis indicated, that the standard deviation of samples at the trial points 1 and 2, containing recycled pulp obtained from RSCK, was 0.5 g/m$^2$. This was on the same level as the standard deviation of samples at the reference point, which did not contain recycled pulp obtained from RSCK (REF). The grammage variability (max−min) was in the range of 3.1 to 3.6 g/m$^2$, in all the measured sample compositions (REF, TP1, TP2). The thickness variability analysis indicated that the standard deviation of samples at the trial points 1 and 2, containing recycled pulp obtained from RSCK (TP1, TP2) was 0.4 μm, which was on the same level as the standard deviation of samples at the reference point, which did not contain recycled pulp obtained from RSCK (REF). The thickness variability (max−min), however, demonstrated a decrease in variability when the amount of recycled pulp obtained from RSCK was larger. In the reference sample (REF), the thickness variability (max−min) was 2.4 μm, whereas the thickness variability (max−min) of the trial points 1 and 2 (TP1, TP2) was 1.9 μm and 2.1 μm, respectively. In addition to reduced shrinkage, the replacement of non-recycled BCP with recycled pulp obtained from RSCK lead into a decrease in the thickness variability, which correlated with the shrinkage results, while maintaining the grammage variability. Thus, both the shrinkage and thickness variability at a paper machine correlated with the amount of the recycled pulp obtained from RSCK. Reduced shrinkage and stable grammage variability are indicators of improved dimensional stability.

Induced Curl Test on Supercalendered Kraft Paper

Figure 11:
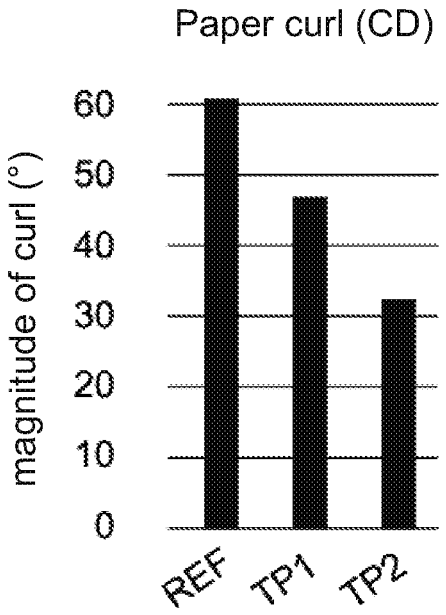
FIG. 11 shows comparative data of induced curl of supercalendered Kraft paper, when measured from test pieces in the cross-direction $S_y$. The results demonstrate that the magnitude of curl correlates inversely with the amount of recycled pulp obtained from RSCK in the furnish. Test pieces which contained higher amount of recycled pulp obtained from RSCK displayed less curl.

Reference is made to FIG. 11. The supercalendered Kraft paper samples produced in the industrial scale trial run were further evaluated for induced curl into the cross-direction $S_y$, denoted as paper curl (CD). A curl was induced in conditions of 1 minute at a temperature of 150° C. (laboratory oven) and measured immediately afterwards. The induced curl method was selected, since it is indicative of the processability of a supercalendered Kraft paper when used as a substrate for a release coating. A release coating is typically cured in conditions resembling the selected situation.

A modified version of a test method ISO 11556:2005(en) was used for measuring the induced curl. A rectangular test piece from the middle of a paper sheet that had been allowed to stabilize in NTP conditions (25° C., 1 bar) 24 hours after production was cut, having a shape with a length of 10 cm (in the cross-direction $S_y$ of the paper) and a width of 5 cm (in the machine direction $S_x$ of the paper). The test piece was set on a cylindrical holder having a diameter of 10 mm and a slot extending over 5 cm along the length of the holder, such that the test piece, when set into the slot, was suspended by the slot from its whole width from the middle, each half of the test piece length thus able to extend freely for a distance of 4.5 cm in opposite directions. The cylindrical holder was attached on a curl template for measuring the magnitude of the induced curl. Prior to inducing curl, the test specimen was aligned parallel with a reference place. The reference plane was given a value of zero. Since the induced curl on the suspended test piece approximates the arc of a circle, markings were imprinted on the template which indicated an angle of curvature deviating from the reference plane. The magnitude of curl was thus imprinted into the template as the angle of curvature of the curled test piece from a reference plane, in units of degree of angle. The curl of the test piece was compared to the angle of curvature imprinted on the curl template; the curvature on both sides was recorded. Two test pieces were measured and the four recorded values were averaged. The result of the curl test was thus an average value of the recorded four values. If the recorded curl was towards wire-side, the curl was positive. If the recorded curl was towards top-side, the curl was negative. The wire-side, in this context, refers to the side of the paper that upon forming the paper web has been in contact with the papermaking machine's forming wire. The top-side, in this context, refers to the opposite side of the paper.

The results evidence that a replacement of non-recycled BCP with recycled pulp obtained from RSCK leads to a steady decrease in the curl value, which is proportional to the amount of the recycled pulp obtained from RSCK in the supercalendered Kraft paper. In samples without recycled pulp obtained from RSCK (REF), the measured curl was 61 mm. In samples containing 15 wt. % of recycled pulp obtained from RSCK (TP1), the measured curl was 47 mm. In samples containing 30 wt. % of recycled pulp obtained from RSCK (TP2), the measured curl was 32 mm. Therefore, a replacement of 15 wt. % of non-recycled BCP by recycled pulp obtained from RSCK resulted into a curl decrease of 23% in the supercalendered Kraft paper. Moreover, a replacement of 30 wt. % of non-recycled BCP by recycled pulp obtained from RSCK resulted into a curl decrease of 48% in the supercalendered Kraft paper. The decrease in the curl was evidenced in all measured samples. The induced curl results support and validate the observations disclosed above. Thus, when considering in light of the improved dimensional stability and the drainage discussed above, the supercalendered Kraft paper advantageously contains recycled pulp obtained from supercalendered Kraft paper that has been used as a substrate of a release liner equal to or less than 50 wt. %, such as in the range of 5 to 50 wt. %, preferably in the range of 10 to 45 wt. %, most preferably in the range of 15 to 30 wt. % of the paper, when determined as dry matter content according to SCAN-P 39:80.

Paper Strength Properties

The supercalendered Kraft paper samples produced in the industrial scale trial run were further evaluated for strength properties. The tensile strength in the machine direction (MD) $S_x$ and in the cross-direction (CD) $S_y$, the strain at break in the MD, and the tensile energy absorption in the MD were measured in accordance with ISO 1924-3.

Tensile strength can be used as an indication of the potential resistance of the supercalendered Kraft paper to a web break, when the supercalendered Kraft paper is used as a substrate of a release liner in a labelling operation. The strain at break can be used as an indication of how well the paper will conform to irregular shapes and, along with tensile energy absorption, as an indication of the paper's performance under dynamic straining and stressing. Tensile energy absorption is a measure of the ability of a paper to absorb energy. Tensile energy absorption thus expresses the toughness of the sheet. The parameters thus predict the performance of paper, especially when that paper is subjected to an uneven stress or a dynamic stress. Table 7 (below) indicates the results measured from supercalendered Kraft paper samples that did not contain recycled pulp obtained from RSCK (REF), from supercalendered Kraft paper samples that contained 15 wt. % of the recycled pulp obtained from RSCK (TP1) and from supercalendered Kraft paper samples that contained 30 wt. % of the recycled pulp obtained from RSCK (TP2).

TABLE 7

Comparative results (MD and CD) from supercalendered Kraft paper samples.

| Sample | MD tensile strength (kN/m) | CD tensile strength (kN/m) | MD strain at break (%) | MD tensile energy absorption ($J/m^2$) |
|---|---|---|---|---|
| REF | 5.15 | 2.78 | 1.89 | 66.0 |
| TP1 | 5.38 | 2.76 | 1.90 | 67.5 |
| TP2 | 5.29 | 2.83 | 1.81 | 65.3 |

The results indicate that the paper strength, when determined as tensile strength, strain at break and tensile energy absorption, remained at sufficiently high level in the samples, despite the replacement of non-recycled BCP with recycled pulp obtained from RSCK. No significant changes were observed in the paper strength or orientation properties during the trial.

As a summary of the results, the compatibility of recycled pulp produced from release liner supercalendered Kraft paper is excellent for supercalendered Kraft paper production. Positive effects in supercalendered Kraft paper manufacturing process, such as improved dewatering both when forming the paper web and at the press section, improved drainage at the drying section, better were measured with several different methods, while maintaining the properties of the supercalendered Kraft paper at sufficient level for use as a substrate for a release liner. The improved manufacturing process was perceivable also in the produced supercalendered Kraft paper, which demonstrated reduced shrinkage, better dimensional stability and reduced curl.

The invention claimed is:

1. A supercalendered Kraft paper suitable for use as a substrate of a release liner, the supercalendered Kraft paper comprising fibers from non-recycled bleached chemical pulp produced from hardwood, non-recycled bleached chemical pulp produced from softwood, and recycled pulp obtained from supercalendered Kraft paper that has been used as a substrate of a release liner, the supercalendered Kraft paper having a density equal to or higher than 1.030 g/cm$^3$, when determined according to ISO 534, a transparency equal to or higher than 36%, when determined according to ISO 2469, a CIE whiteness, wherein L* is in the range of 92 to 98, a* is in the range of −4 to +2, and b* is in the range of +5 to +11, when determined according to ISO 11475:2017 (en), and comprising the recycled pulp obtained from supercalendered Kraft paper that has been used as a substrate of a release liner in an amount equal to or higher than 5 wt. %, when determined as dry matter content according to SCAN-P 39:80.

2. The paper according to claim 1, wherein the recycled pulp obtained from supercalendered Kraft paper that has been used as a substrate of a release liner has been prepared of supercalendered Kraft paper having a CIE whiteness, wherein L* is in the range of 92 to 98, a* is in the range of −4 to +2, and b* is in the range of +5 to +11, when determined according to ISO 11475:2017 (en).

3. The paper according to claim 1, wherein the recycled pulp obtained from supercalendered Kraft paper that has been used as a substrate of a release liner has not been bleached.

4. The paper according to claim 1, the supercalendered Kraft paper comprising the recycled pulp obtained from supercalendered Kraft paper that has been used as a substrate of a release liner in an amount equal to or higher than 10 wt. %, when determined as dry matter content according to SCAN-P 39:80.

5. The paper according to claim 1, the supercalendered Kraft paper comprising the recycled pulp obtained from supercalendered Kraft paper that has been used as a substrate of a release liner in the range of 5 to 50 wt. %, when determined as dry matter content according to SCAN-P 39:80.

6. The paper according to claim 1, the supercalendered Kraft paper comprising non-recycled bleached chemical pulp produced from softwood in an amount equal to or higher than 10 wt. %, when determined as dry matter content according to SCAN-P 39:80.

7. The paper according to claim 1, the supercalendered Kraft paper having a grammage in the range of 50 to 120 g/m$^2$ determinable by standard ISO 536, a density in the range of 1.030 to 1.190 g/cm$^3$, determinable by standard ISO 534, and/or a transparency in the range of 36 to 56%, determinable by standard ISO 2469.

8. A release liner comprising a supercalendered Kraft paper according to claim 1 and a release coating.

* * * * *